US011419395B2

(12) United States Patent
Yamashita

(10) Patent No.: US 11,419,395 B2
(45) Date of Patent: Aug. 23, 2022

(54) BAND AND WATCH

(71) Applicant: Seiko Epson Corporation, Tokyo (JP)

(72) Inventor: Yuki Yamashita, Shiojiri (JP)

(73) Assignee: Seiko Epson Corporation

( * ) Notice: Subject to any disclaimer, the term of this patent is extended or adjusted under 35 U.S.C. 154(b) by 73 days.

(21) Appl. No.: 17/111,600

(22) Filed: Dec. 4, 2020

(65) Prior Publication Data

US 2021/0169182 A1 Jun. 10, 2021

(30) Foreign Application Priority Data

Dec. 6, 2019 (JP) ..... JP2019-221007

(51) Int. Cl.
*A44C 5/14* (2006.01)
*A44C 5/10* (2006.01)
*A44C 5/20* (2006.01)

(52) U.S. Cl.
CPC ..... *A44C 5/14* (2013.01); *A44C 5/105* (2013.01); *A44C 5/2061* (2013.01)

(58) Field of Classification Search
CPC ..... A44C 5/14; A44C 5/105; A44C 5/2061
See application file for complete search history.

(56) References Cited

U.S. PATENT DOCUMENTS 3,550,893 A * 12/1970 Waitzkin ..... A01K 89/00 24/265 R
3,824,783 A * 7/1974 Nadeau ..... G04B 37/1493 968/360
4,564,308 A * 1/1986 Ikegami ..... A44C 5/14 968/360
4,935,996 A * 6/1990 Ferrara ..... A44B 11/2596 24/587.11
5,483,505 A * 1/1996 Cartier ..... G04B 37/1493 368/282
6,647,593 B2 * 11/2003 Iguchi ..... A44C 5/14 74/56
8,240,011 B2 * 8/2012 Chevrolet ..... G04B 37/1493 24/265 B
9,092,012 B2 * 7/2015 Dornhege ..... E05D 7/1011
9,314,071 B2 * 4/2016 Rivera ..... G04B 37/1493
(Continued)

FOREIGN PATENT DOCUMENTS

JP 2004-187978 A 7/2004

*Primary Examiner* — David M Upchurch
(74) *Attorney, Agent, or Firm* — Harness, Dickey & Pierce, P.L.C.

(57) ABSTRACT

A band of the present disclosure includes: a spring bar including a shaft member and an operation portion; an outer piece including a first arm portion and a second arm portion; and a middle piece disposed between the first arm portion and the second arm portion. The first arm portion includes a first recessed portion provided along an axial direction of the shaft member, the second arm portion includes a first insertion hole provided along the axial direction, and the middle piece includes a second insertion hole provided along the axial direction, and a second recessed portion provided along the axial direction and in communication with the second insertion hole. The spring bar is inserted through the first recessed portion, the second insertion hole, the second recessed portion, and the first insertion hole. The operation portion is disposed protruding from an opening of the second recessed portion.

19 Claims, 21 Drawing Sheets

(56) References Cited

U.S. PATENT DOCUMENTS

| | | | | |
|---|---|---|---|---|
| 9,612,075 | B1 * | 4/2017 | Stephens, IV | F41A 11/00 |
| 10,935,934 | B2 * | 3/2021 | Maire | G04B 37/1493 |
| 2014/0250637 | A1 * | 9/2014 | Stotz | G04B 37/1493 24/265 B |
| 2014/0362544 | A1 * | 12/2014 | Han | G04G 21/04 361/748 |
| 2015/0107299 | A1 * | 4/2015 | Knuchel | F16G 15/00 63/3.2 |
| 2019/0121295 | A1 * | 4/2019 | Romano | G04B 37/1486 |
| 2019/0324403 | A1 * | 10/2019 | Maire | A44C 5/14 |

* cited by examiner

BAND AND WATCH

The present application is based on, and claims priority from JP Application Serial Number 2019-221007, filed Dec. 6, 2019, the disclosure of which is hereby incorporated by reference herein in its entirety.

BACKGROUND

1. Technical Field

The present disclosure relates to a band and a watch.

2. Related Art

In JP-A-2004-187978, a band coupled to a watch case is disclosed. In JP-A-2004-187978, the band and the watch case can be easily coupled by operating an operation terminal of a spring bar attached to the band.

In JP-A-2004-187978, the spring bar is inserted into a cylindrical portion provided at an end of the band, and the spring bar is then attached to the band by bending a stopper provided in the cylindrical portion. In this way, the spring bar is prevented from disengaging from the band as a result of interference between the operation terminal of the spring bar and the stopper.

However, when such a structure for attaching the spring bar is employed, a configuration is necessary in which a portion of a component of the end of the band is bendable. Thus, a problem arises in that it is difficult to achieve this type of disengagement prevention structure by processing a component without bending the component, for example, by processing a pure metal material.

Since it is possible to obtain an excellent high quality feel in terms of design when the component of the end of the band is manufactured by processing the pure metal material, there is a demand for a component of the band that can be manufactured from the pure metal material, and that can incorporate the spring bar including the operation terminal.

SUMMARY

A band according to an aspect of the present disclosure includes a spring bar including a shaft member, an operation portion, and a protruding member, an outer piece including a first arm portion, a second arm portion, and a body portion coupling the first arm portion and the second arm portion, and a middle piece disposed between the first arm portion and the second arm portion. The first arm portion includes a first recessed portion provided along an axial direction of the shaft member, the second arm portion includes a first insertion hole provided along the axial direction, and the middle piece includes a second insertion hole provided along the axial direction and a second recessed portion provided along the axial direction and in communication with the second insertion hole. The first recessed portion, the second insertion hole, the second recessed portion, and the first insertion hole are disposed in this order along the axial direction, and the spring bar is inserted through the first recessed portion, the second insertion hole, the second recessed portion, and the first insertion hole. The operation portion is disposed protruding from an opening of the second recessed portion, and the operation portion is configured to move in the axial direction in this state.

A band according to another aspect of the present disclosure includes a spring bar including a shaft member, an operation portion, and a protruding member, an outer piece including a first outer piece component and a second outer piece component, and a middle piece that is disposed between the first outer piece component and the second outer piece component. The first outer piece component includes a first outer piece insertion hole provided along an axial direction of the shaft member, the second outer piece component includes a second outer piece insertion hole provided along the axial direction, and the middle piece includes a middle piece insertion hole provided along the axial direction and a middle piece recessed portion provided along the axial direction and in communication with the middle piece insertion hole. The first outer piece insertion hole, the middle piece insertion hole, the middle piece recessed portion, and the second outer piece insertion hole are disposed in this order along the axial direction, and the spring bar is inserted through the first outer piece insertion hole, the middle piece insertion hole, the middle piece recessed portion, and the second outer piece insertion hole. The operation portion is disposed protruding from an opening of the middle piece recessed portion, and the operation portion is configured to move in the axial direction in this state.

A watch according to another aspect of the present disclosure includes the band.

DESCRIPTION OF EXEMPLARY EMBODIMENTS

First Embodiment

A first embodiment of the present disclosure will be described below with reference to the drawings.

Figure 1:
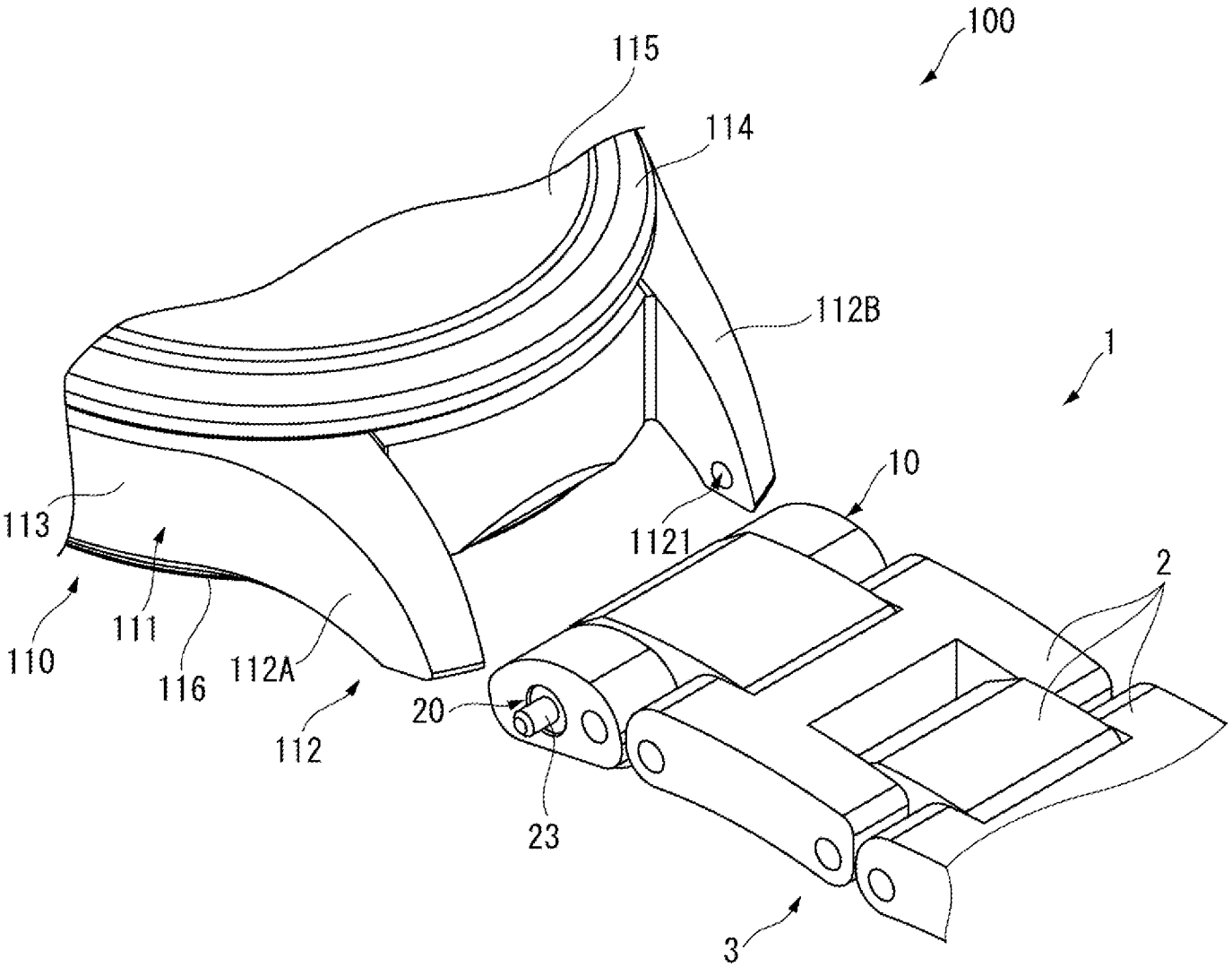
FIG. 1 is a perspective view illustrating main portions of a watch according to a first embodiment.

FIG. 1 is a perspective view illustrating main portions of a watch 100 according to the first embodiment.

As illustrated in FIG. 1, the watch 100 includes a watch body 110 and a band 1.

The watch body 110 includes a case 111 and bows 112.

The case 111 includes a case body 113, a bezel 114, a cover glass 115, and a case back 116.

The case body 113 is a cylindrical member formed of metal, and a dial, a movement, and the like (not illustrated) are disposed inside the case body 113.

The bezel 114 is a circular member formed of metal and is disposed on an upper portion of the case body 113. The cover glass 115 is disposed so as to cover an opening on the upper side of the case body 113, is fixed by the bezel 114, and covers the dial (not illustrated). The case back 116 is a member formed of metal and is disposed so as to cover an opening on the lower side of the case body 113.

The bows 112 are respectively provided in the direction of 6 o'clock and 12 o'clock on the case body 113. Then, each of the bows 112 includes a pair of holding pieces 112A and 112B that are provided protruding from a side surface of the case body 113. The holding pieces 112A and 112B are each provided with a hole portion 1121 into which protruding members 23 and 24 of a spring bar 20 to be described later are inserted.

Band

Figure 2:
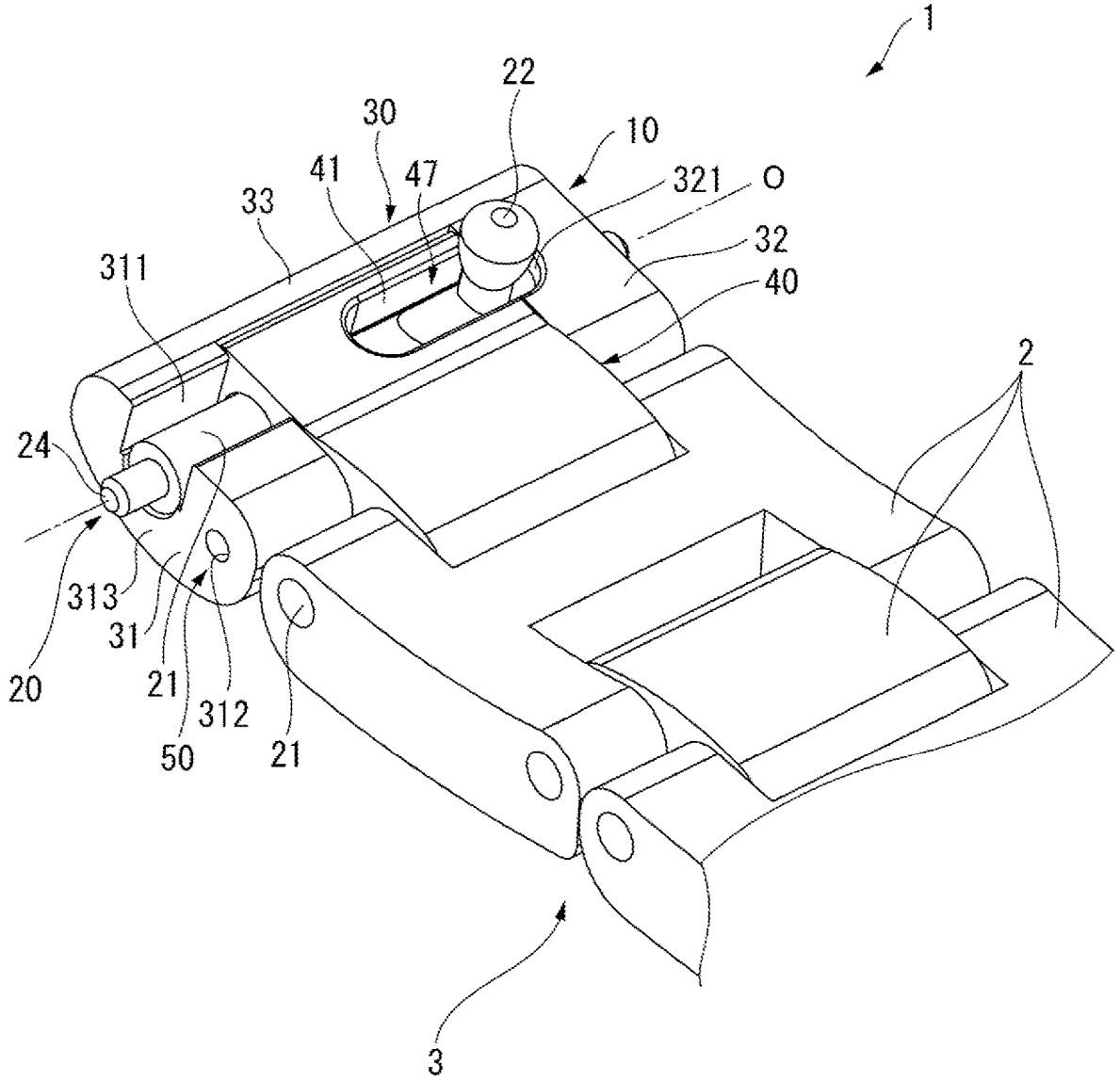
FIG. 2 is a perspective view illustrating the band according to the first embodiment.
Figure 3:
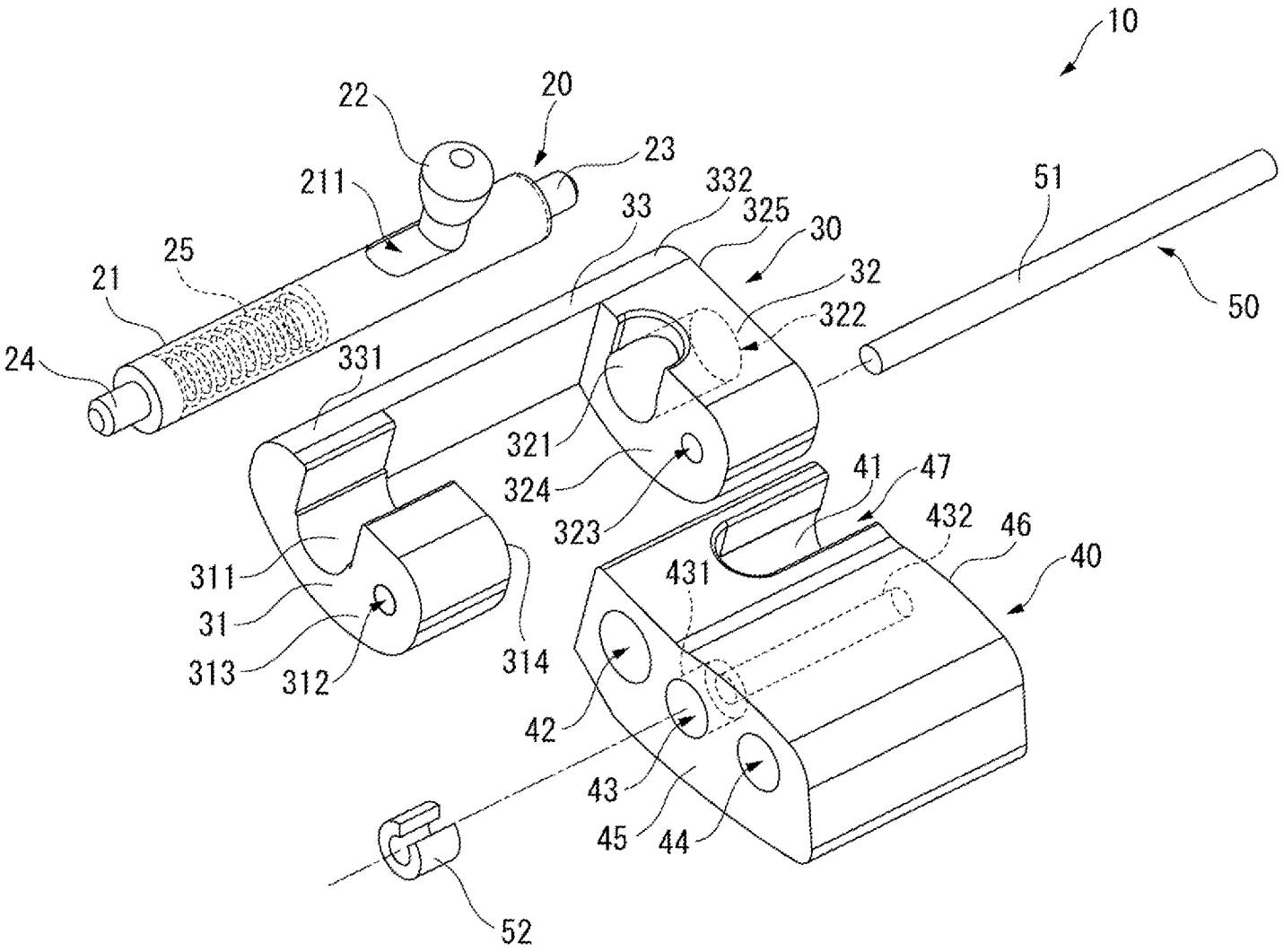
FIG. 3 is an exploded perspective view illustrating a coupling tool according to the first embodiment.
Figure 4:
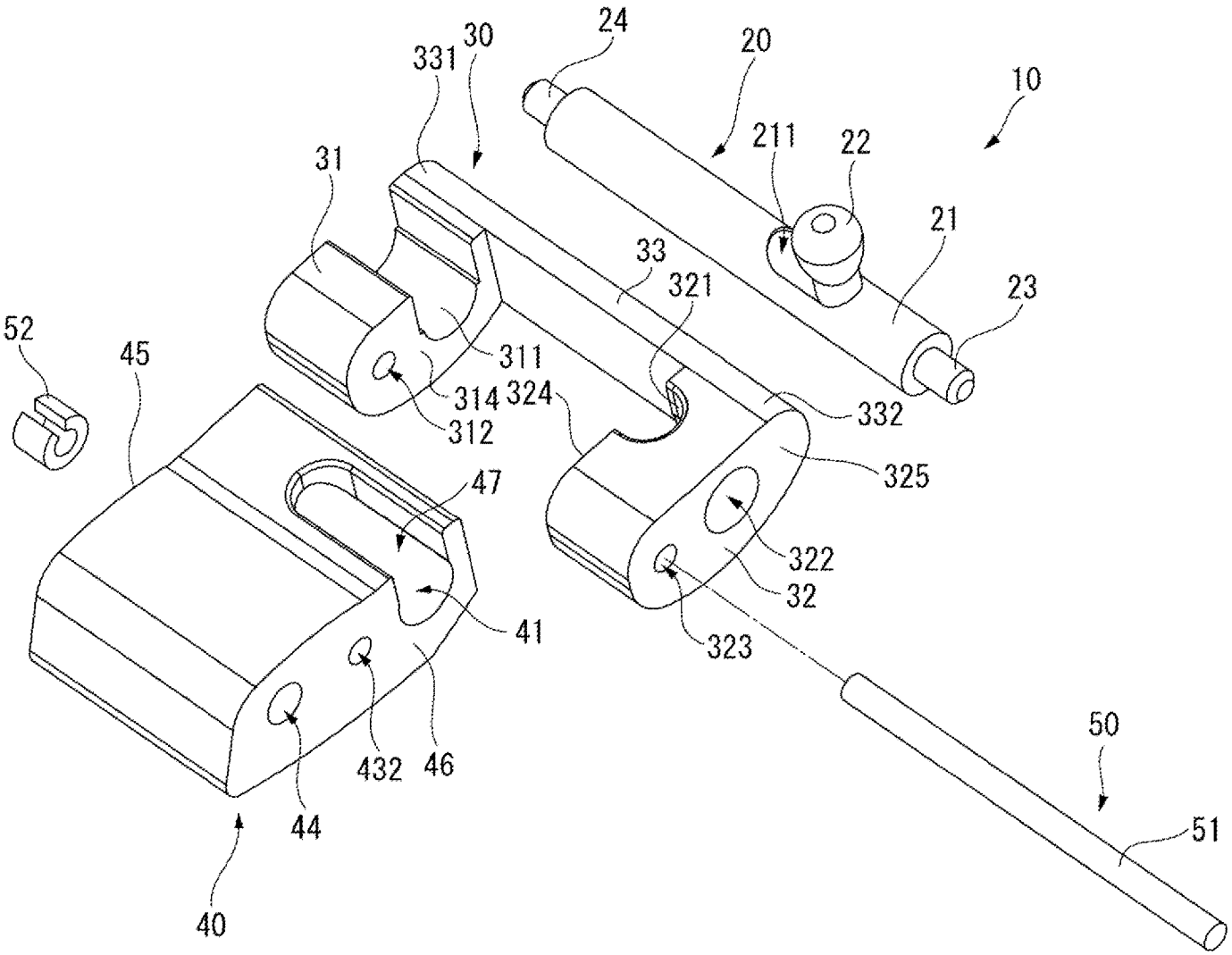
FIG. 4 is an exploded perspective view illustrating the coupling tool according to the first embodiment.

FIG. 2 is a perspective view illustrating the band 1, and FIG. 3 and FIG. 4 are exploded perspective views illustrating a coupling tool 10. Note that in FIG. 3 and FIG. 4, the coupling tool 10 is viewed from different directions. Further, the coupling tool 10 is a so-called end piece for attaching the band 1 to the watch body 110.

As illustrated in FIG. 1 to FIG. 4, the band 1 includes a band main body 3 configured by combining a plurality of metal pieces 2, and the coupling tool 10 that is coupled to both ends of the band main body 3 and that is attached to the pair of holding pieces 112A and 112B. Note that in FIG. 1, only the coupling tool 10 attached to the holding pieces 112A and 112B in the direction of 6 o'clock of the watch 100 is illustrated.

Coupling Tool

The coupling tool 10 includes the spring bar 20, an outer piece 30, a middle piece 40, and a fixing member 50.

Spring Bar

The spring bar 20 is a member for removably coupling the coupling tool 10 to the pair of holding pieces 112A and 112B. In the present embodiment, the spring bar 20 includes a shaft member 21, an operation portion 22, a first protruding member 23, a second protruding member 24, and a spring member 25. Further, the spring bar 20 is inserted through a first arm recessed portion 311, a middle piece insertion hole 42, a middle piece recessed portion 41, a second arm recessed portion 321, and a second arm insertion hole 322, all of which will be described later.

The shaft member 21 is made of metal and has a cylindrical shape, and an opening is provided at both end portions thereof. Then, an elongated hole 211 is provided in the outer circumferential surface of the shaft member 21. Note that the length of the shaft member 21 is configured to be substantially equal to a length in the width direction of the outer piece 30, that is, a length from a first side surface 313 of a first arm portion 31 to a second side surface 325 of a second arm portion 32, which will be described later.

The operation portion 22 is provided so as to protrude from the first protruding member 23 in a direction orthogonal to an axial direction O of the shaft member 21, and protrudes from the elongated hole 211 of the shaft member 21. In the present embodiment, the operation portion 22 is integrally provided with the first protruding member 23. Then, the operation portion 22 is configured to be movable within the elongated hole 211 along the axial direction O. In this way, the first protruding member 23 integrally provided with the operation portion 22 can be moved along the axial direction O, and thus the coupling tool 10 can be attached to and removed from the bow 112 of the watch 100. In other words, the elongated hole 211 is provided having a length such that the first protruding member 23 is separated from the hole 1121 of the bow 112 when the operation portion 22 is moved along the axial direction O. Note that the axial direction O is the direction orthogonal to the direction in which the band body 3 of the band 1 extends.

Further, when the spring bar 20 is housed in the outer piece 30 and the middle piece 40, the operation portion 22 is disposed protruding from an opening 47 of the middle piece recessed portion 41, which will be described later. In this way, in the state in which the spring bar 20 is housed in the outer piece 30 and the middle piece 40, the operation portion 22 can move inside the middle piece recessed portion 41 and the second arm recessed portion 321 along the axial direction O of the shaft member 21.

A large diameter base end of the first protruding member 23 is housed inside the shaft member 21. Then, a small diameter tip end protrudes along the axial direction O from the opening provided at the first end of the shaft member 21.

Further, the first protruding member 23 is urged by the spring member 25 such that the tip end protrudes along the axial direction O of the shaft member 21. At this time, the first protruding member 23 is in a state in which the large diameter base end is engaged with the end of the shaft member 21.

Furthermore, the first protruding member 23 is disposed so that the tip end protrudes from the outer piece 30 along the axial direction O in the state in which the spring bar 20 is housed in the outer piece 30 and the middle piece 40.

A large diameter base end of the second protruding member 24 is housed inside the shaft member 21. Then, a small diameter tip end is disposed so as to protrude along the axial direction O from the opening provided at the second end of the shaft member 21.

Further, the second protruding member 24 is urged by the spring member 25 so as to protrude along the axial direction O of the shaft member 21. At this time, the second protruding member 24 is in a state in which the large diameter base end portion is engaged with the end of the shaft member 21.

Furthermore, the second protruding member 24 is disposed so that the tip end protrudes from the outer piece 30 in the state in which the spring bar 20 is housed in the outer piece 30 and the middle piece 40. Note that the first protruding member 23 and the second protruding member 24 are examples of a protruding member of the present disclosure.

The spring member 25 is a so-called coil spring and is housed inside the shaft member 21. Then, the spring member 25 is in contact with the end on the base end side of the first protruding member 23 and the end on the base end side of the second protruding member 24, and urges the first protruding member 23 and the second protruding member 24 to respectively protrude from the shaft member 21 along the axial direction O.

Outer Block

The outer piece 30 is a member that is coupled with the middle piece 40 to house the spring bar 20. In the present embodiment, the outer piece 30 is formed by subjecting a pure metal material to a process such as cutting or the like.

The outer piece 30 includes the first arm portion 31, the second arm portion 32, and a body portion 33.

The first arm portion 31 is provided so as to extend from a first end 331 of the body portion 33 in a direction orthogonal to the longitudinal direction of the body portion 33. The first arm portion 31 is provided with the first arm recessed portion 311 and a first arm fixing hole 312.

The first arm recessed portion 311 is a recessed portion in which the shaft member 21 of the spring bar 20 is disposed, and is provided along the axial direction O of the shaft member 21. In the present embodiment, the first arm recessed portion 311 is provided extending from the first side surface 313 to a second side surface 314 of the first arm portion 31. Further, the first arm recessed portion 311 is provided so as to be open to the back surface side of the watch 100 when the band 1 is attached to the watch 100. Note that the first arm recessed portion 311 is an example of a first recessed portion of the present disclosure.

The first arm fixing hole 312 is a hole into which the fixing member 50 is inserted, and is provided along the axial direction of a pin 51 of the fixing member 50, which will be described later. In the present embodiment, the first arm fixing hole 312 penetrates the first arm portion 31 from the first side surface 313 to the second side surface 314.

The second arm portion 32 is provided so as to extend from a second end 332 of the body portion 33 in a direction orthogonal to the longitudinal direction of the body portion 33. In other words, the first arm portion 31 and the second arm portion 32 extend in parallel to each other. Note that, in the present embodiment, the first arm portion 31 and the second arm portion 32 extend from the body portion 33 toward a side on which the piece 2 is disposed.

The second arm portion 32 is provided with the second arm recessed portion 321, the second arm insertion hole 322, and a second arm fixing hole 323.

The second arm recessed portion 321 is a recessed portion in which the shaft member 21 of the spring bar 20 is disposed, and is provided along the axial direction O of the shaft member 21. In the present embodiment, the second arm recessed portion 321 is provided from a first side surface 324 of the second arm portion 32 to the vicinity of the center of the second arm portion 32. Further, the second arm recessed portion 321 is provided in a position corresponding to the middle piece recessed portion 41 of the middle piece 40, which will be described below, that is, adjacent to the middle piece recessed portion 41. Furthermore, the second arm recessed portion 321 is provided so as to be open to the back surface side of the watch 100 when the band 1 is attached to the watch 100. Note that the second arm recessed portion 321 is an example of a third recessed portion of the present disclosure.

The second arm insertion hole 322 is a hole through which the shaft member 21 of the spring bar 20 is inserted, and is provided along the axial direction O of the shaft member 21. In the present embodiment, the second arm insertion hole 322 is in communication with the second arm recessed portion 321, and penetrates the second arm portion 32 from the second arm recessed portion 321 to the second side surface 325 of the second arm portion 32. Note that the second arm insertion hole 322 is an example of a first insertion hole of the present disclosure.

The second arm fixing hole 323 is a hole into which the fixing member 50 is inserted, and is provided along the axial direction of the pin 51 of the fixing member 50, which will be described later. In the present embodiment, the second arm fixing hole 323 penetrates the second arm portion 32 from the first side surface 324 to the second side surface 325.

The body portion 33 couples the first arm portion 31 and the second arm portion 32. In the present embodiment, the body portion 33 is formed in a rod shape, and is provided such that the longitudinal direction thereof extends in a direction parallel to the axial direction O of the shaft member 21 of the spring bar 20. Further, as described above, the first arm portion 31 extends from the first end 331 of the body portion 33, and the second arm portion 32 extends from the second end 332.

Middle Block

The middle piece 40 is a member that is coupled to the outer piece 30 in order to house the spring bar 20, and is disposed, by the fixing member 50, between the first arm portion 31 and the second arm portion 32. In the present embodiment, the middle piece 40 is formed by subjecting a pure metal material to a process such as cutting or the like.

The middle piece 40 is provided with the middle piece recessed portion 41, the middle piece insertion hole 42, a middle piece fixing hole 43, and a middle piece coupling hole 44.

The middle piece recessed portion 41 is a recessed portion in which the shaft member 21 of the spring bar 20 is disposed, and is provided along the axial direction O of the shaft member 21. In the present embodiment, the middle piece recessed portion 41 is provided from the vicinity of the center of the middle piece 40 to a side surface 46 of the middle piece 40. Further, the middle piece recessed portion 41 is provided at a position corresponding to the second arm insertion hole 322 of the second arm portion 32, and is in communication with the middle piece insertion hole 42. Furthermore, the middle piece recessed portion 41 is provided so as to be open to the back surface side of the watch 100 when the band 1 is attached to the watch 100. Note that the middle piece recessed portion 41 is an example of a second recessed portion of the present disclosure.

The middle piece insertion hole 42 is a hole through which the shaft member 21 of the spring bar 20 is inserted, and is provided along the axial direction O of the shaft member 21. In the present embodiment, the middle piece insertion hole 42 is provided in a position corresponding to the first arm recessed portion 311, that is, adjacent to the first arm recessed portion 311. Further, the middle piece insertion hole 42 penetrates the middle piece 40 from a side surface 45 of the middle piece 40 to the middle piece recessed portion 41.

In this way, in the present embodiment, the first arm recessed portion 311, the middle piece insertion hole 42, the middle piece recessed portion 41, the second arm recessed portion 321, and the second arm insertion hole 322 are arranged in this order along the axial direction O. Note that the middle piece insertion hole 42 is an example of a second insertion hole of the present disclosure.

The middle piece fixing hole 43 is a hole into which the fixing member 50 is inserted, is provided along the axial direction O of the pin 51 of the fixing member 50, which will be described below, and penetrates the middle piece 40 from the first side surface 45 to the second side surface 46. In the present embodiment, the middle piece fixing hole 43 includes a large diameter portion 431 and a small diameter portion 432 having a diameter smaller than that of the large diameter portion 431. Then, a C-ring 52 of the fixing member 50, which will be described below, is disposed in the large diameter portion 431.

The middle piece coupling hole 44 is a hole through which a coupling member (not illustrated) for coupling the middle piece 40 and the piece 2 is inserted. In the present embodiment, the middle piece coupling hole 44 penetrates the middle piece 40 from the first side surface 45 to the second side surface 46.

Fixing Member

The fixing member 50 is a member for fixing the middle piece 40 between the first arm portion 31 and the second arm portion 32 of the outer piece 30. In the present embodiment, the fixing member 50 includes the pin 51 and the C-ring 52.

The pin 51 is made of metal and is inserted into the first arm fixing hole 312, the middle piece fixing hole 43, and the second arm fixing hole 323. Further the pin 51 is configured such that the outer diameter thereof is substantially equal to the inner diameter of each of the first arm fixing hole 312, the small diameter portion 432 of the middle piece fixing hole 43, and the second arm fixing hole 323.

The C-ring 52 is configured from a metal such as stainless steel and, as described above, is disposed in the large diameter portion 431 of the middle piece fixing hole 43. Then, the pin 51 is inserted inside the C-ring 52.

Next, a method of assembling the coupling tool 10 will be described.

Figure 5:
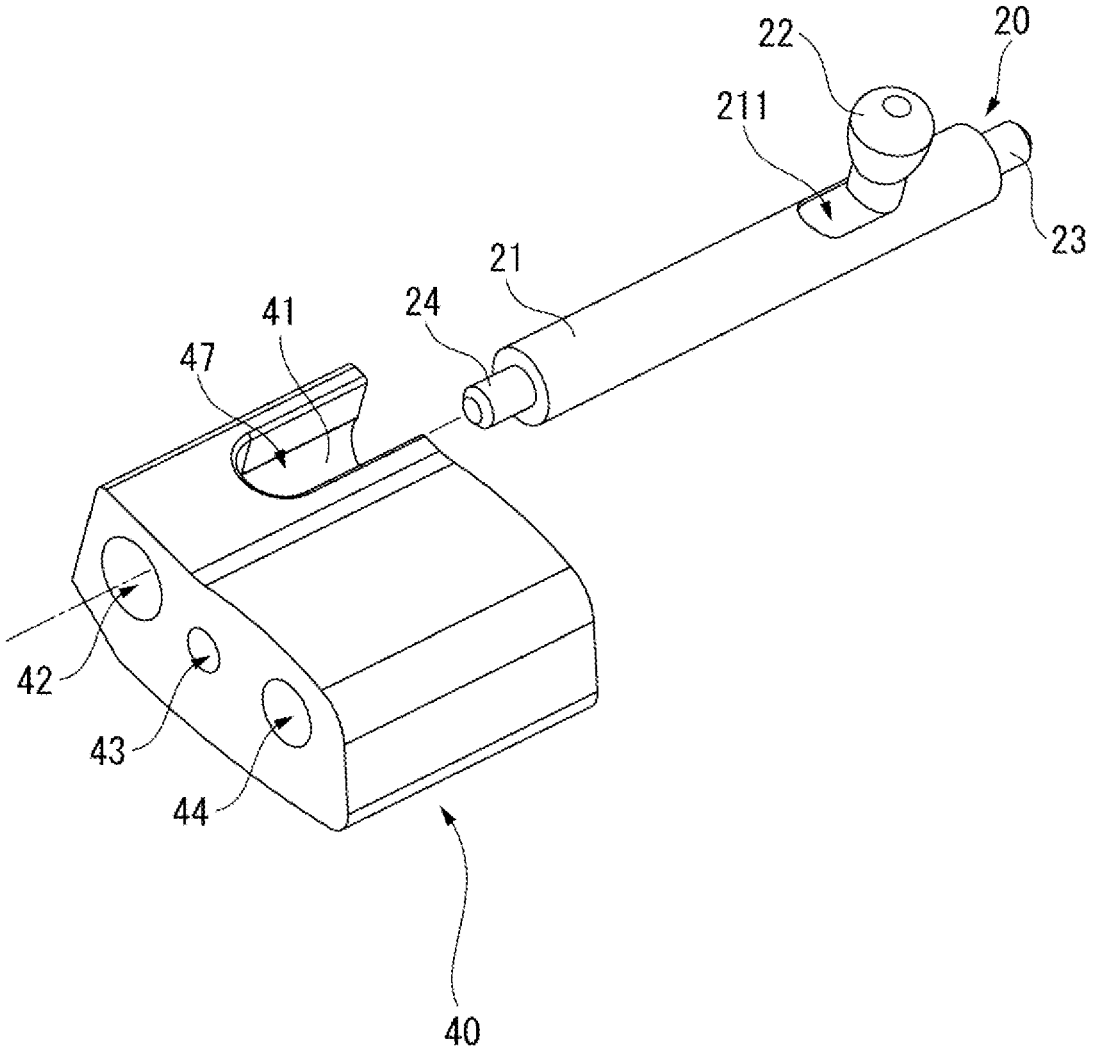
FIG. 5 is a perspective view illustrating a method of assembling the coupling tool according to the first embodiment.
Figure 6:
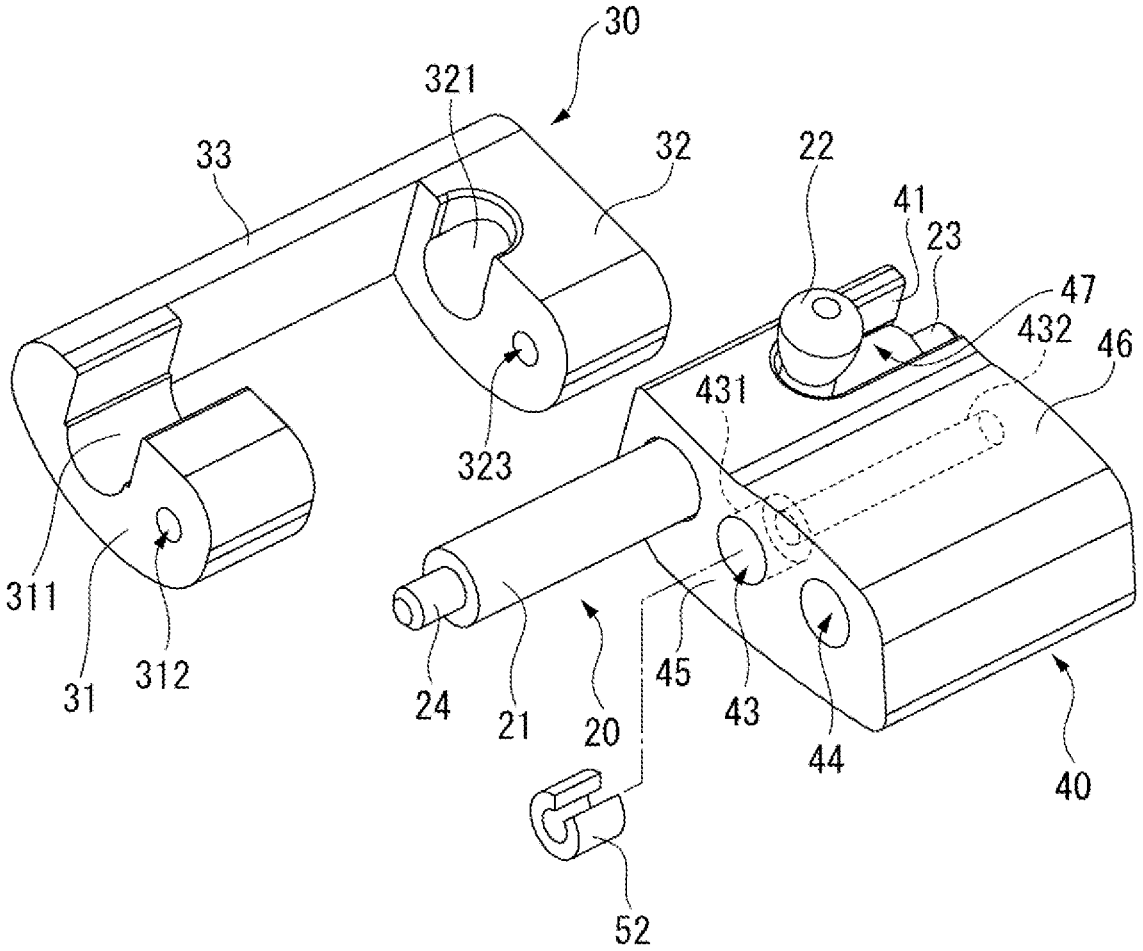
FIG. 6 is a perspective view illustrating the method of assembling the coupling tool according to the first embodiment.
Figure 7:
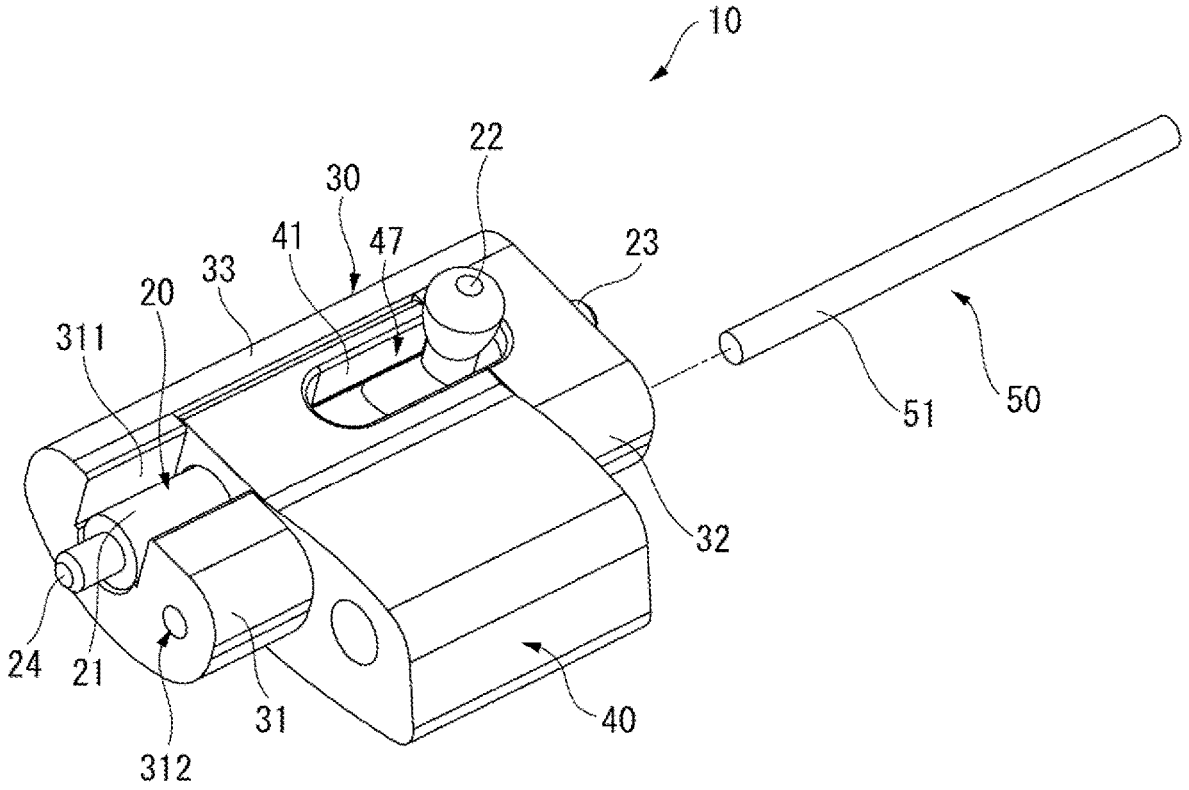
FIG. 7 is a perspective view illustrating the method of assembling the coupling tool according to the first embodiment.

FIG. 5 to FIG. 7 are perspective views illustrating the method of assembling the coupling tool 10.

First, as illustrated in FIG. 5, the shaft member 21 of the spring bar 20 is inserted through the middle piece insertion hole 42 of the middle piece 40. In this way, the spring bar 20 is disposed in the middle piece recessed portion 41 and the middle piece insertion hole 42 of the middle piece 40. At this time, the spring bar 20 is arranged such that the operation portion 22 protrudes from the opening 47 of the middle piece recessed portion 41.

Next, as illustrated in FIG. 6, the operation portion 22 of the spring bar 20 is moved along the axial direction O, and the operation portion 22 is engaged with the middle piece 40. Then, the C-ring 52 is disposed in the large diameter portion 431 of the middle piece fixing hole 43.

In this state, the middle piece 40 is disposed between the first arm portion 31 and the second arm portion 32 of the outer piece 30. At this time, the shaft member 21 of the spring bar 20 is disposed in the first arm recessed portion 311 of the first arm portion 31.

Further, at this time, the first protruding member 23 is disposed in the second arm recessed portion 321. In other words, the middle piece recessed portion 41 is formed such that the tip end of the first protruding member 23 protrudes from the side surface 46 of the middle piece 40 in a state in which the operation portion 22 is engaged with the middle piece 40.

Therefore, in a state in which the first protruding member 23 protrudes from the side surface 46 of the middle piece 40, the first protruding member 23 does not interfere with the second arm portion 32, and thus, the middle piece 40 can be disposed between the first arm portion 31 and the second arm portion 32.

Next, as illustrated in FIG. 7, the operation portion 22 of the spring bar 20 is moved along the axial direction O, and the shaft member 21 is inserted through the second arm insertion hole 322 of the second arm portion 32. In this way, for example, when the operation portion 22 is moved toward the first arm portion 31, the operation portion 22 interferes with the middle piece 40 when the operation portion 22 has been moved by a predetermined amount. Further, when the shaft member 21 is moved toward the second arm portion 32, the operation portion 22 interferes with the second arm portion 32 when the operation portion 22 has been moved by a predetermined amount. Thus, when the operation portion 22 is moved along the axial direction O, it is possible to suppress the spring bar 20 from becoming disengaged from the outer piece 30 and the middle piece 40.

Finally, the pin 51 is inserted into the first arm fixing hole 312, the middle piece fixing hole 43, and the second arm fixing hole 323. As a result of this, the pin 51 is pressed into the inner side of the C-ring 52 disposed in the large diameter portion 431 of the middle piece fixing hole 43, and the C-ring 52 deforms toward the outer circumferential side. In this way, the C-ring 52 is engaged with the large diameter portion 431, and the pin 51 does not become disengaged from the first arm fixing hole 312, the middle piece fixing hole 43, and the second arm fixing hole 323. Thus, the middle piece 40 is fixed to the outer piece 30 by the fixing member 50.

Effects of First Embodiment

According to the first embodiment as described above, the following effects can be obtained.

In the present embodiment, the spring bar 20 is disposed so as to penetrate the first arm recessed portion 311, the middle piece insertion hole 42, the middle piece recessed portion 41, and the second arm insertion hole 322, and such that the operating part 22 protrudes from the opening 47 of the middle piece recessed portion 41. Further, the spring bar 20 is configured such that the operation portion 22 can move in the axial direction O in a state of being housed in the outer piece 30 and the middle piece 40.

In this way, when the operation portion 22 is moved along the axial direction O, it is possible to suppress the spring bar 20 from becoming disengaged from the outer piece 30 and the middle piece 40.

Further, since the disengagement prevention structure of the spring bar 20 can be achieved without bending a part of the metal component, the outer piece 30 and the middle piece 40 configuring the disengagement prevention structure can be manufactured from the pure metal material. As a result, the spring bar 20 including the operation portion 22 can be incorporated, and the band 1 having excellent design properties and a high quality feel can be obtained.

In the present embodiment, the second arm recessed portion 321 is provided in the second arm portion 32, so the middle piece 40 can be disposed between the first arm portion 31 and the second arm portion 32 in a state in which the first protruding member 23 protrudes from the middle piece 40. Thus, the assembly of the coupling tool 10 can be made easy.

In the present embodiment, the middle piece 40 is fixed between the first arm portion 31 and the second arm portion 32 by the C-ring 52 and the pin 51. In this way, the middle piece 40 can be fixed to the outer piece 30 with a simple fixing structure. Further, since the middle piece 40 can be removed from the outer piece 30 if the pin 51 is removed, it is possible to replace the middle piece 40, such as when the middle piece 40 is damaged, for example.

Second Embodiment

Next, a band 1A according to a second embodiment of the present disclosure will be described below with reference to the drawings.

The band 1A of the second embodiment differs from the first embodiment described above in that a middle piece 40A includes a plurality of middle piece components 410A, 420A, and 430A. Note that components of the second embodiment that are identical or similar to the corresponding components of the first embodiment are denoted by identical reference signs and that descriptions of these components are omitted.

Figure 8:
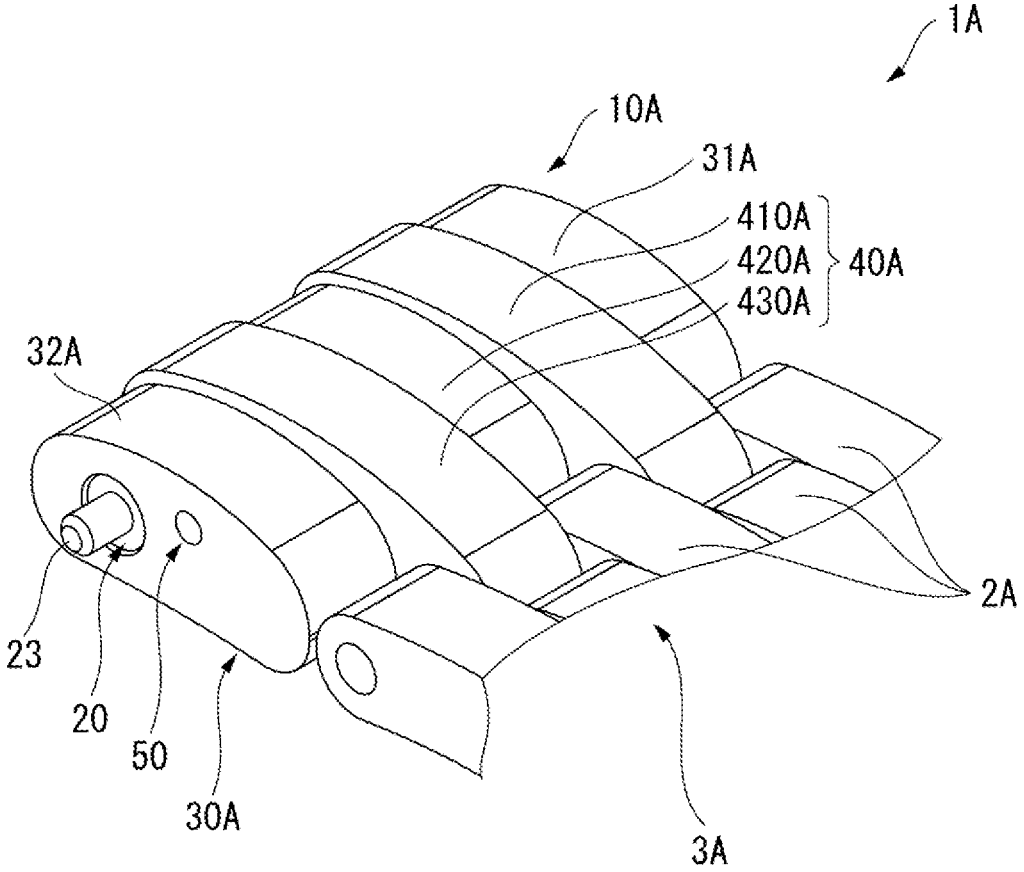
FIG. 8 is a perspective view illustrating a band according to a second embodiment.
Figure 9:
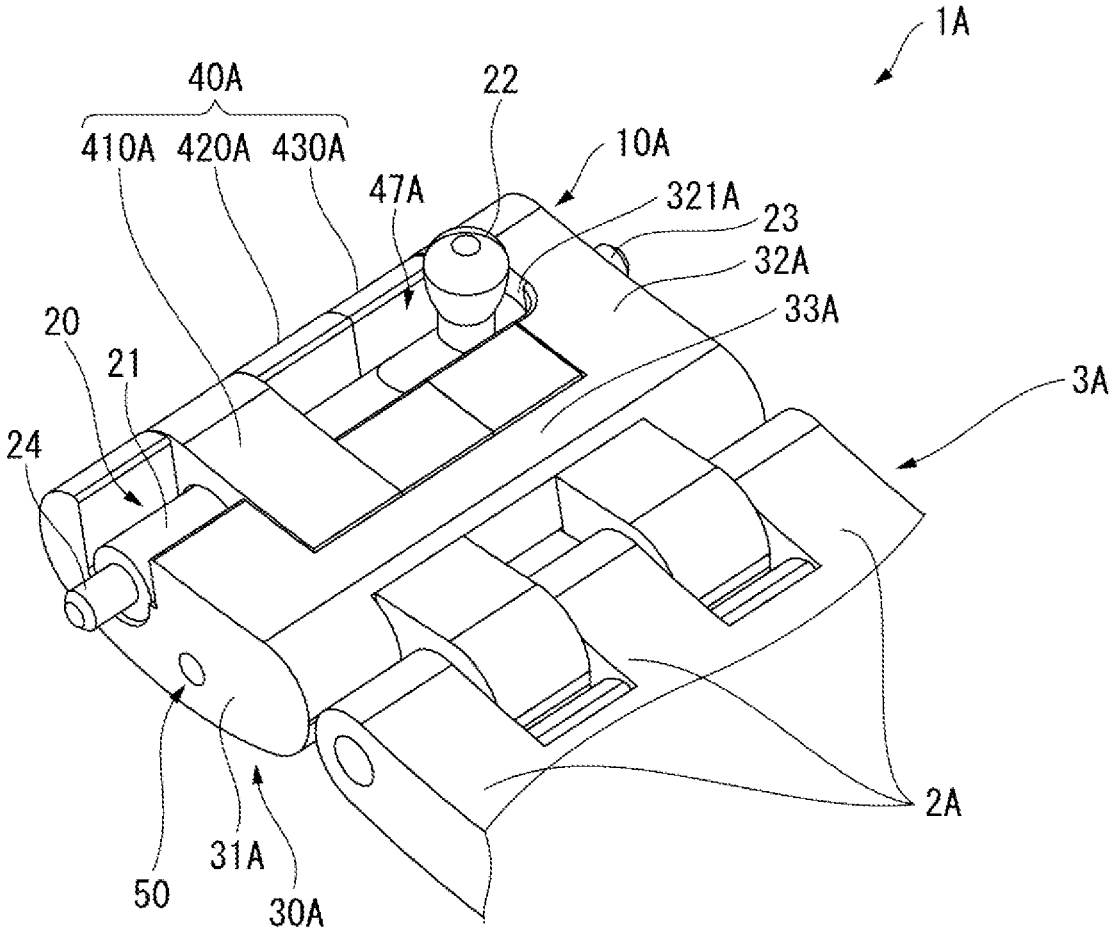
FIG. 9 is a perspective view illustrating the band according to the second embodiment.

FIG. 8 and FIG. 9 are perspective views illustrating the band 1A according to the second embodiment. Note that in FIG. 8 and FIG. 9, the band 1A is viewed from different directions.

As illustrated in FIG. 8 and FIG. 9, in a similar manner to the first embodiment described above, the band 1A includes a band main body 3A configured by combining a plurality of metal pieces 2A, and a coupling tool 10A that is coupled to both ends of the band main body 3A.

Coupling Tool

Figure 10:
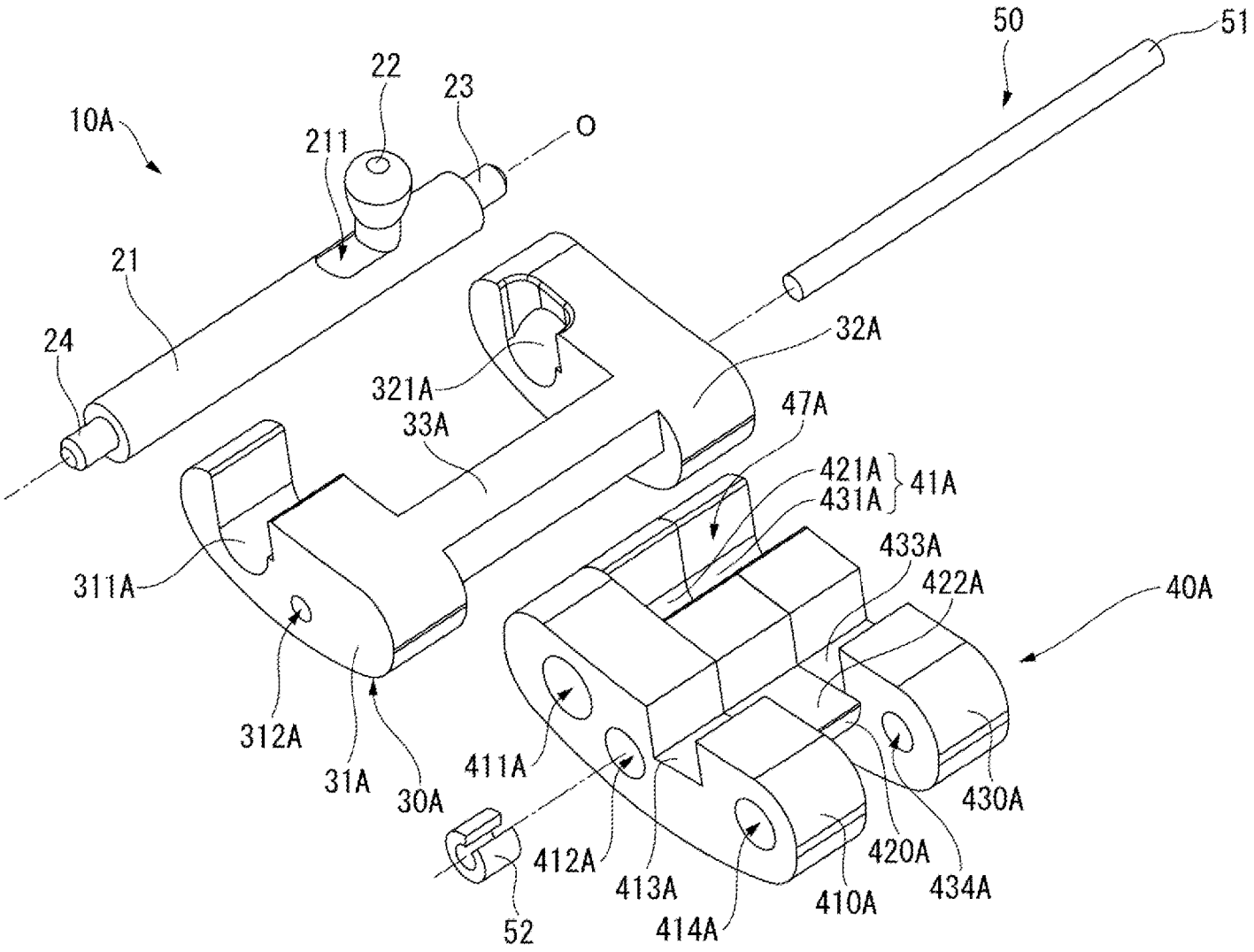
FIG. 10 is an exploded perspective view illustrating the the band according to the second embodiment.
Figure 11:
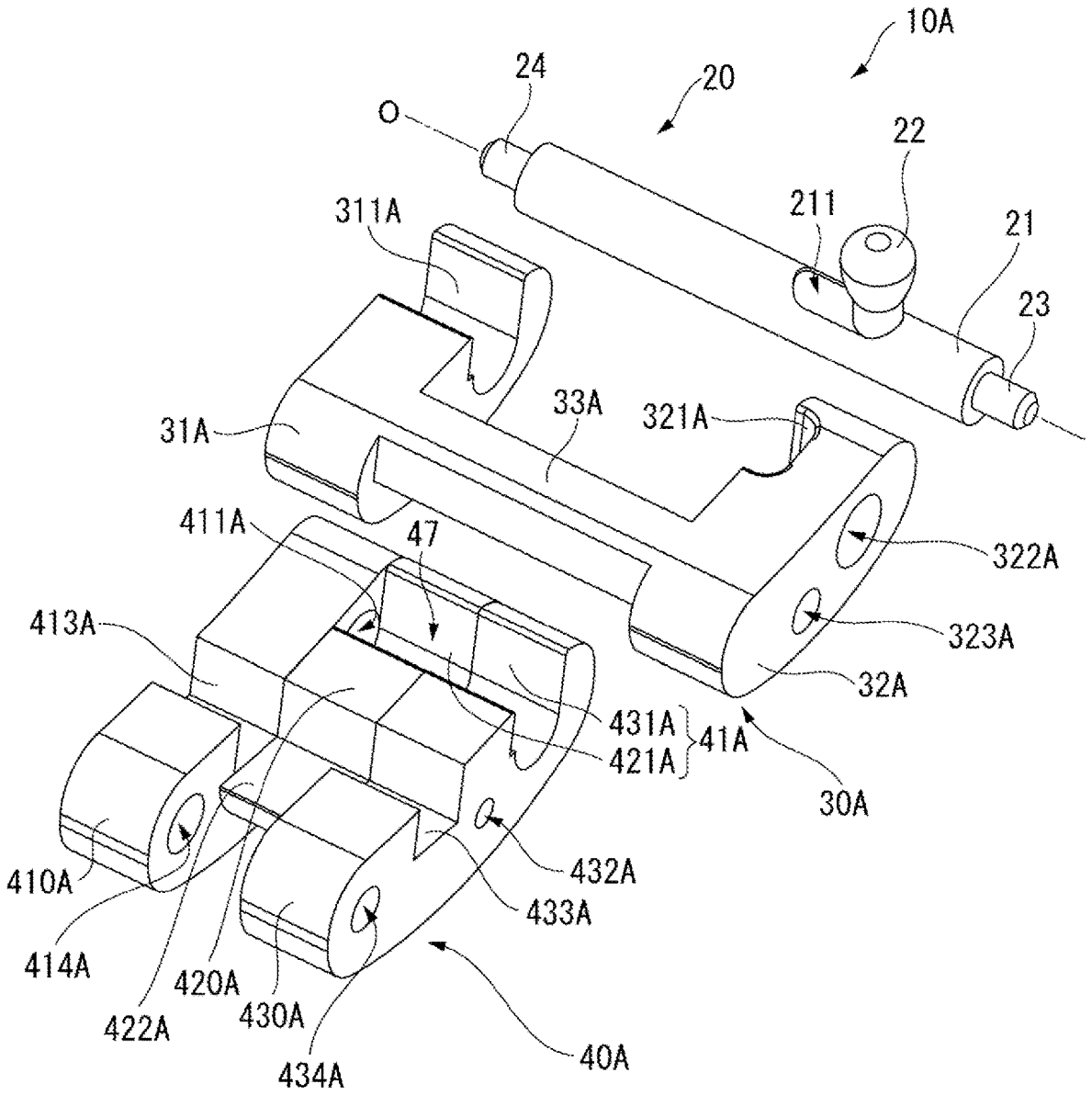
FIG. 11 is an exploded perspective view illustrating the the band according to the second embodiment.

FIG. 10 and FIG. 11 are exploded perspective views illustrating the coupling tool 10A. Note that in FIG. 10 and FIG. 11, the coupling tool 10A is viewed from different directions.

As illustrated in FIG. 8 to FIG. 11, in a similar manner to the first embodiment described above, the coupling tool 10A is a so-called end piece, and includes the spring bar 20, an outer piece 30A, a middle piece 40A, and the fixing member 50.

Outer Block

The outer piece 30A includes a first arm portion 31A, a second arm portion 32A, and a body portion 33A, in a similar manner to the first embodiment described above.

In a similar manner to the first embodiment described above, a first arm recessed portion 311A and a first arm fixing hole 312A are provided in the first arm portion 31A.

Further, in a similar manner to the first embodiment described above, a second arm recessed portion 321A, a second arm insertion hole 322A, and a second arm fixing hole 323A are provided in the second arm portion 32A.

In a similar manner to the first embodiment described above, the body portion 33A couples the first arm portion 31A and the second arm portion 32A. Note that in the present embodiment, the first arm portion 31A and the second arm portion 32A extend from the body portion 33A toward a side opposite to the side on which the pieces 2A are disposed.

Middle Block

In the present embodiment, the middle piece 40A includes three pieces, namely, the first middle piece component 410A, the second middle piece component 420A, and the third middle piece component 430A. Further, in the present embodiment, the middle piece components 410A, 420A, and 430A are formed by subjecting a pure metal material to a process such as cutting or the like. Furthermore, in the present embodiment, the middle piece components 410A, 420A, and 430A are disposed side by side along the axial direction O of the shaft member 21, between the first arm portion 31A and the second arm portion 32A.

The first middle piece component 410A is a component that is disposed adjacent to the first arm portion 31A. The first middle piece component 410A is provided with a first middle piece insertion hole 411A, a first middle piece fixing hole 412A, a first middle piece engagement recessed portion 413A, and a first middle piece coupling hole 414A.

The first middle piece insertion hole 411A is a hole through which the shaft member 21 of the spring bar 20 is inserted, and is provided along the axial direction O of the shaft member 21. In the present embodiment, the first middle piece insertion hole 411A is provided at a position corresponding to the first arm recessed portion 311A, that is, adjacent to the first arm recessed portion 311A. Further, the first middle piece insertion hole 411A penetrates the first middle piece component 410A along the axial direction O, and is in communication with a second middle piece recessed portion 421A of the second middle piece component 420A, which will be described later. Note that the first middle piece insertion hole 411A is an example of the second insertion hole of the present disclosure.

The first middle piece fixing hole 412A is a hole into which the fixing member 50 is inserted, is provided along the axial direction of the pin 51, and penetrates the first middle piece component 410A. In the present embodiment, the C-ring 52 is disposed in the first middle piece fixing hole 412A. In other words, the first middle piece fixing hole 412A configures the large diameter portion 431 of the first embodiment described above.

The first middle piece engagement recessed portion 413A engages with the body portion 33A of the outer piece 30A when the middle piece 40A is disposed between the first arm portion 31A and the second arm portion 32A of the outer piece 30A. In the present embodiment, the first middle piece engagement recessed portion 413A is provided along the longitudinal direction of the body portion 33A. Further, the first middle piece engagement recessed portion 413A is provided so as to be open to the back surface side of the watch 100 when the band 1A is attached to the watch 100. Note that the first middle piece engagement recessed portion 413A is an example of an engagement recessed portion of the present disclosure.

The first middle piece coupling hole 414A is a hole through which a coupling member (not illustrated) for coupling the first middle piece component 410A and the piece 2A is inserted.

The second middle piece component 420A is a component that is disposed between the first middle piece component 410A and the third middle piece component 430A. The second middle piece component 420A is provided with the second middle piece recessed portion 421A and a second middle piece engagement portion 422A. Further, although not illustrated in the drawings, a second middle piece fixing hole into which the fixing member 50 is inserted is provided in the second middle piece recessed portion 421A, at a position corresponding to the first middle piece fixing hole 412A.

The second middle piece recessed portion 421A is a recessed portion in which the shaft member 21 of the spring bar 20 is disposed, and is provided along the axial direction O of the shaft member 21. In the present embodiment, the second middle piece recessed portion 421A is provided at a position corresponding to the first middle piece insertion hole 411A and a third middle piece recessed portion 431A, which will be described later. Further, the second middle piece recessed portion 421A is provided so as to be open to the back surface side of the watch 100 when the band 1A is attached to the watch 100.

The second middle piece engagement portion 422A engages with the body portion 33A of the outer piece 30A when the middle piece 40A is disposed between the first arm portion 31A and the second arm portion 32A of the outer piece 30A.

The third middle piece component 430A is a component that is disposed adjacent to the second arm portion 32A. The third middle piece component 430A is provided with the third middle piece recessed portion 431A, a third middle piece fixing hole 432A, a third middle piece engagement recessed portion 433A, and a third middle piece coupling hole 434A.

The third middle piece recessed portion 431A is a recessed portion in which the shaft member 21 of the spring bar 20 is disposed, and is provided along the axial direction O of the shaft member 21. In the present embodiment, the third middle piece recessed portion 431A is provided at a position corresponding to the second middle piece recessed portion 421A and the second arm recessed portion 321A.

The third middle piece recessed portion 431A is provided so as to be open to the back surface side of the watch 100 when the band 1A is attached to the watch 100.

Furthermore, the third middle piece recessed portion 431A together with the second middle piece recessed portion 421A configures a middle piece recessed portion 41A. Note that the middle piece recessed portion 41A is an example of the second recessed portion of the present disclosure.

Further, in a similar manner to the first embodiment described above, the operation portion 22 of the spring bar 20 is disposed so as to protrude from an aperture 47A of the middle piece recessed portion 41A.

The third middle piece fixing hole 432A is a hole into which the fixing member 50 is inserted, and is provided along the axial direction of the pin 51. In the present embodiment, the third middle piece fixing hole 432A penetrates the third middle piece component 430A along the axial direction of the pin 51. Note that the second middle piece fixing hole (not illustrated) and the third middle piece fixing hole 432A configure the small diameter portion 432 of the first embodiment described above.

The third middle piece engagement recessed portion 433A engages with the body portion 33A of the outer piece 30A when the middle piece 40A is disposed between the first arm portion 31A and the second arm portion 32A of the outer piece 30A. In the present embodiment, the third middle piece engagement recessed portion 433A is provided along the longitudinal direction of the body portion 33A.

Further, the third middle piece engagement recessed portion 433A is provided so as to be open to the back surface side of the watch 100 when the band 1A is attached to the watch 100. Note that the third middle piece engagement recessed portion 433A is an example of the engagement recessed portion of the present disclosure.

The third middle piece coupling hole 434A is a hole through which a coupling member (not illustrated) for coupling the third middle piece component 430A and the piece 2A is inserted.

Next, a method of assembling the coupling tool 10A will be described.

Figure 12:
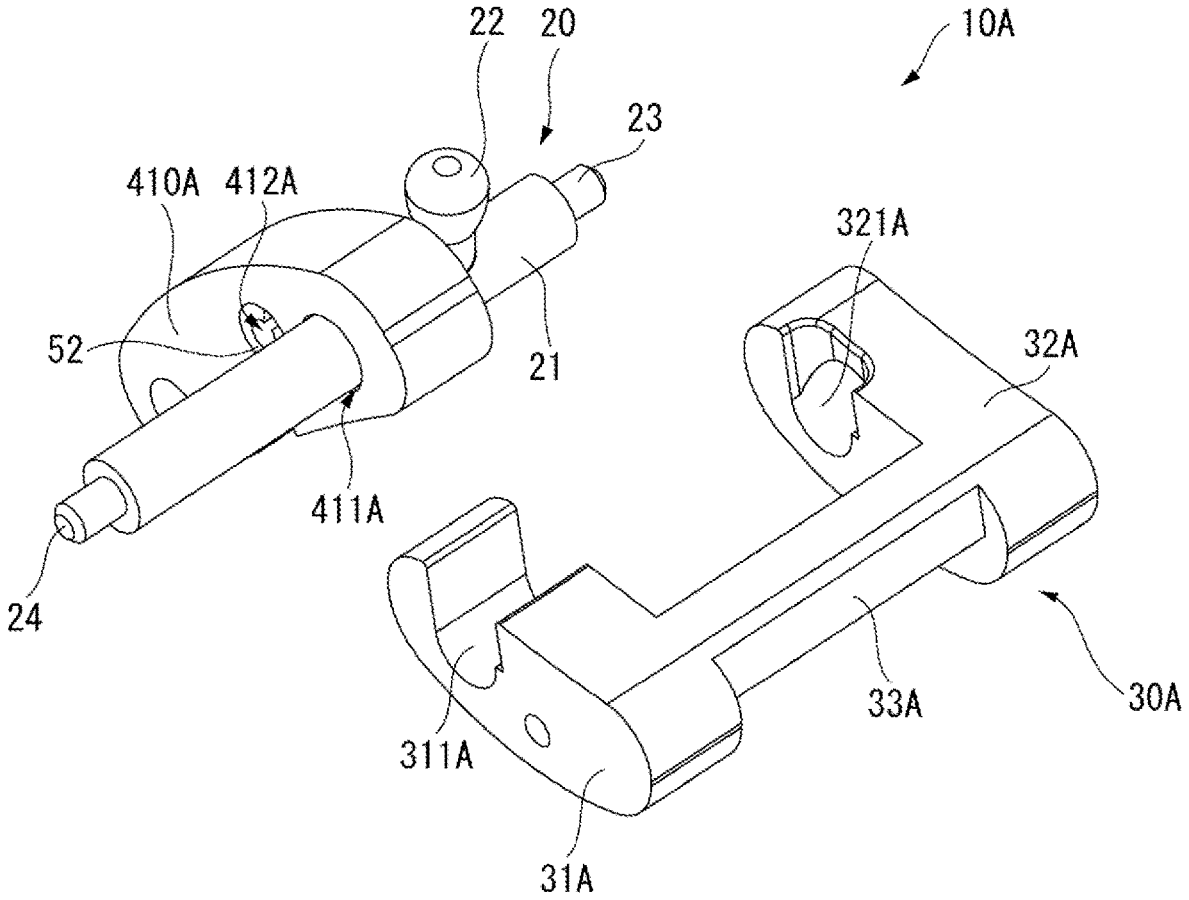
FIG. 12 is a perspective view illustrating a method of assembling a coupling tool according to the second embodiment.
Figure 13:
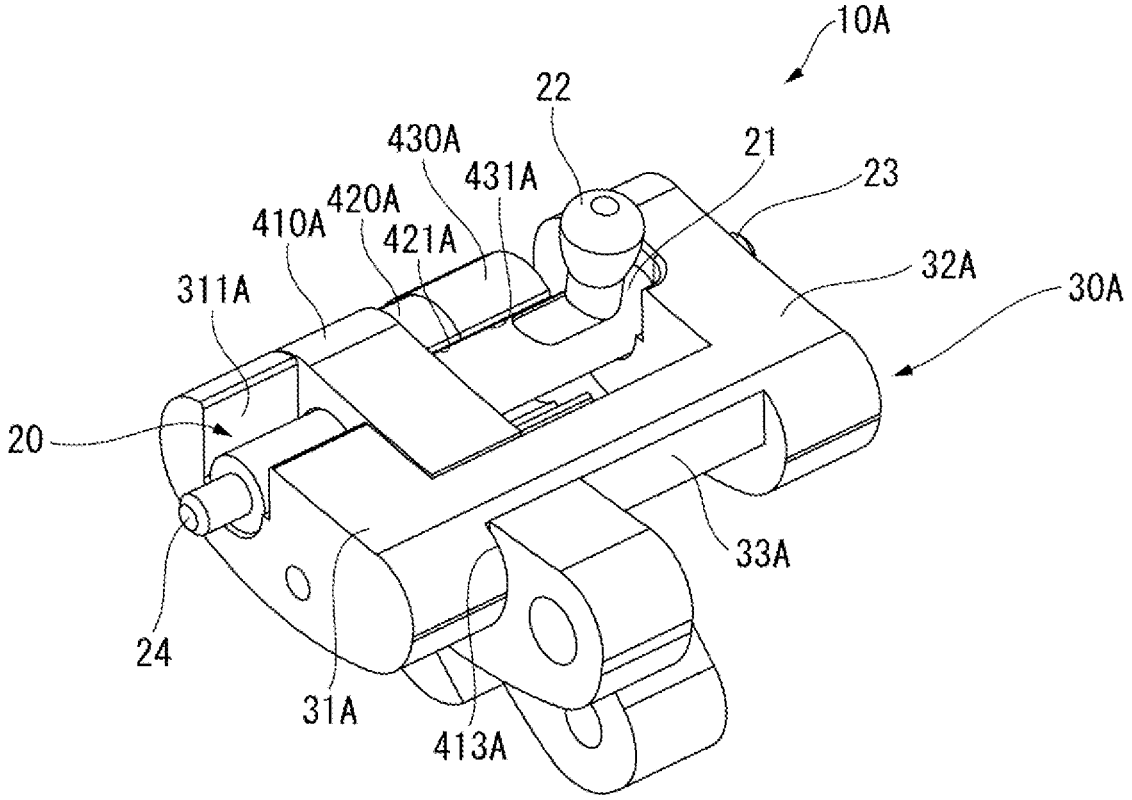
FIG. 13 is a perspective view illustrating the method of assembling the coupling tool according to the second embodiment.
Figure 14:
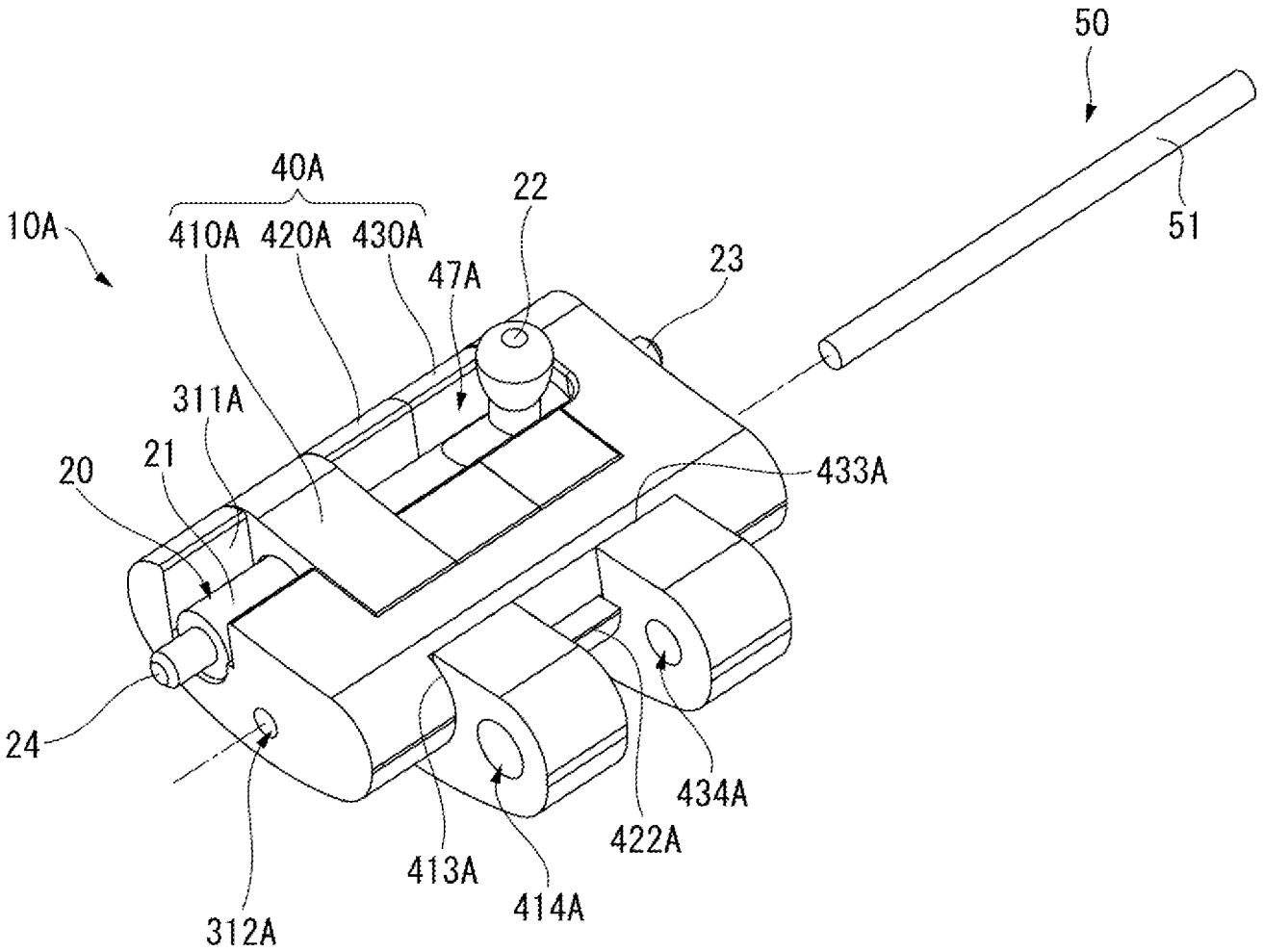
FIG. 14 is a perspective view illustrating the method of assembling the coupling tool according to the second embodiment.

FIG. 12 to FIG. 14 are perspective views illustrating the method of assembling the coupling tool 10A.

First, as illustrated in FIG. 12, the shaft member 21 of the spring bar 20 is inserted through the first middle piece insertion hole 411A of the first middle piece component 410A. Then, the operation portion 22 is moved along the axial direction O and the operation portion 22 is engaged with the first middle piece component 410A. Next, the C-ring 52 is disposed in the first middle piece fixing hole 412A.

In this state, the first middle piece component 410A is disposed adjacent to the inner side of the first arm portion 31A of the outer piece 30A, and the shaft member 21 is engaged with the first arm recessed portion 311A.

Next, as illustrated in FIG. 13, the operation portion 22 is moved along the axial direction O, and the shaft member 21 is inserted through the second arm insertion hole 322A of the second arm portion 32A. Then, the first middle piece component 410A is rotated using the shaft member 21 as a rotary shaft, and the first middle piece engagement recessed portion 413A is engaged with the body portion 33A of the outer piece 30A.

Next, the second middle piece 420A and the third middle piece 430A are disposed between the first middle piece component 410A and the second arm portion 32A, and are engaged with the shaft member 21 of the spring bar 20. Specifically, the second middle piece recessed portion 421A of the second middle piece component 420A is engaged with the shaft member 21, and the third middle piece recessed portion 431A of the third middle piece component 430A is engaged with the shaft member 21.

Next, as illustrated in FIG. 14, the second middle piece 420A and the third middle piece 430A are rotated, using the shaft member 21 as a center of rotation. In this way, the second middle piece engagement portion 422A of the second middle piece component 420A is engaged with the body portion 33A of the outer piece 30A, and the third middle piece engagement recessed portion 433A of the third middle piece component 430A is engaged with the body portion 33A.

Then, the pin 51 is inserted into the first arm fixing hole 312A, the first middle piece fixing hole 412A, the second middle piece fixing hole, the third middle piece fixing hole 432A, and the second arm fixing hole 323A. In this way, the middle piece 40A configured to include the first middle piece component 410A, the second middle piece component 420A, and the third middle piece component 430A is fixed between the first arm portion 31A and the second arm portion 32A of the outer piece 30A.

Effects of Second Embodiment

According to the second embodiment as described above, the following effects can be obtained.

In the present embodiment, the middle piece 40A includes the plurality of middle piece components 410A, 420A, and 430A.

In this way, it is possible to increase variations in the design of the middle piece 40A configuring the band 1A. For this reason, design of the band 1A can be further enhanced.

In the present embodiment, the middle piece 40A is provided with the engagement recessed portions 413A and 433A that engage with the body portion 33A.

In this way, the middle piece 40A is fixed to the outer piece 30A after the engagement recessed portions 413A and 433A and the body portion 33A are engaged with each other, and it is thus possible to more reliably fix the middle piece 40A with respect to the outer piece 30A. Further, by engaging the engagement recessed portions 413A and 433A with the body portion 33A, the positions of the middle piece fixing holes 412A and 432A can be determined, and assembly of the coupling tool 10A can thus be made easy.

Third Embodiment

Next, a band 1B according to a third embodiment of the present disclosure will be described below with reference to the drawings.

The band 1B of the third embodiment differs from the first embodiment described above in that an outer piece 30B includes a plurality of outer piece components 310B and 320B. Note that components of the third embodiment that are identical or similar to the corresponding components of the first and second embodiments are denoted by identical reference signs and that descriptions of these components are omitted.

Figure 15:
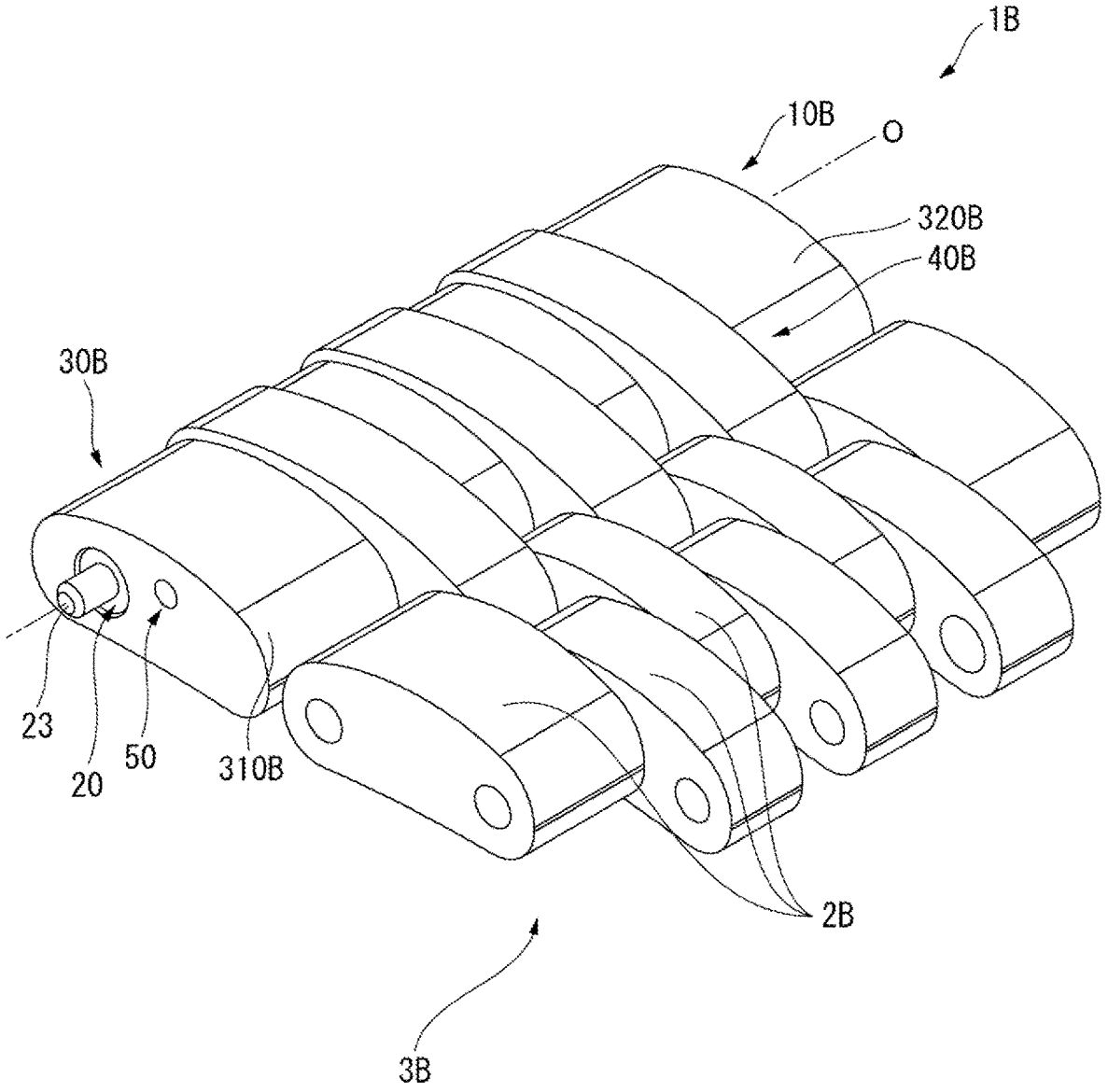
FIG. 15 is a perspective view illustrating a band according to a third embodiment.
Figure 16:
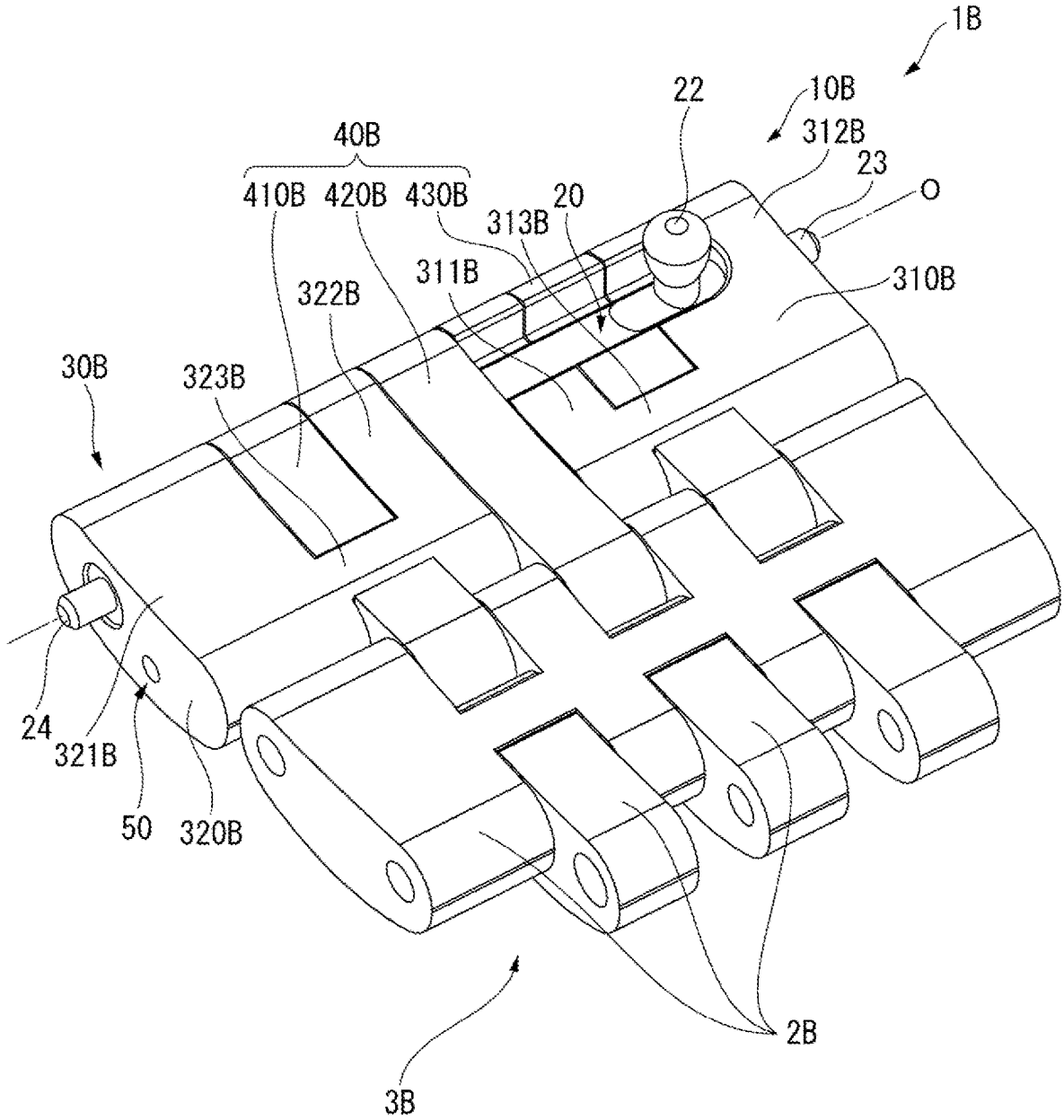
FIG. 16 is a perspective view illustrating the band according to the third embodiment.

FIG. 15 and FIG. 16 are perspective views illustrating the band 1B according to the third embodiment. Note that in FIG. 15 and FIG. 16, the band 1B is viewed from different directions.

As illustrated in FIG. 15 and FIG. 16, in a similar manner to the first and second embodiments described above, the band 1B includes a band main body 3B configured by combining a plurality of metal pieces 2B, and a coupling tool 10B that is coupled to both ends of the band main body 3B.

Coupling Tool

Figure 17:
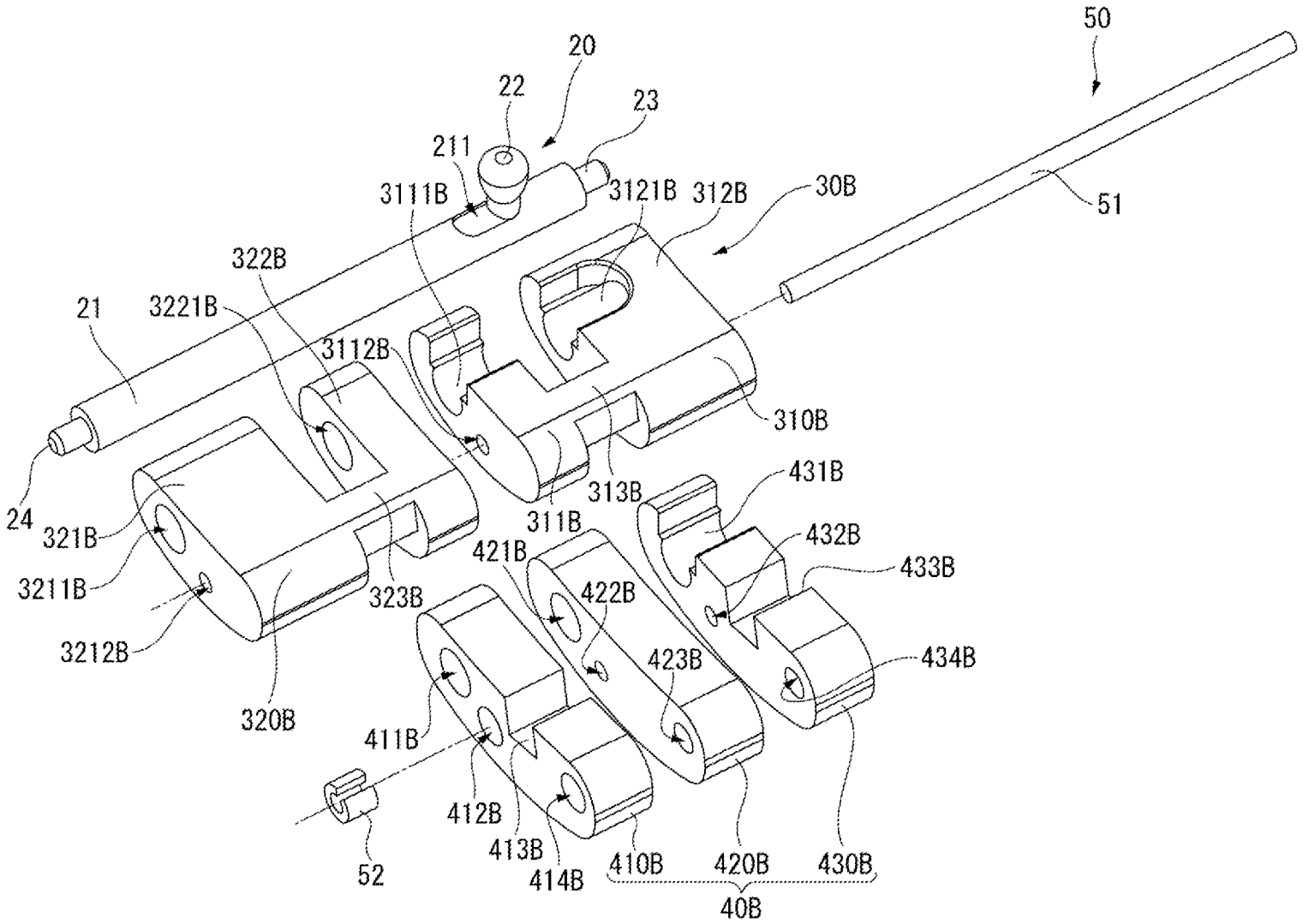
FIG. 17 is an exploded perspective view illustrating a coupling tool according to the third embodiment.

FIG. 17 is an exploded perspective view illustrating the coupling tool 10B.

As illustrated in FIG. 15 to FIG. 17, in a similar manner to the first and second embodiments described above, the coupling tool 10B is a so-called end piece, and includes the spring bar 20, an outer piece 30B, a middle piece 40B, and the fixing member 50.

Outer Block

In the present embodiment, the outer piece 30B includes two components, namely, a first outer piece component 310B and a second outer piece component 320B. Further, in the present embodiment, the outer piece components 310B and 320B are formed by subjecting a pure metal material to a process such as cutting or the like. Furthermore, in the present embodiment, the first outer piece component 310B and the second outer piece component 320B are disposed side by side along the axial direction O of the shaft member 21.

The first outer piece component 310B includes a first arm portion 311B, a second arm portion 312B, and a first body portion 313B.

The first arm portion 311B is provided with a first arm recessed portion 3111B in which the shaft member 21 of the spring bar 20 is disposed, and a first arm fixing hole 3112B into which the fixing member 50 is inserted.

A second arm recessed portion 3121B in which the shaft member 21 of the spring bar 20 is disposed is provided in the second arm portion 312B. Further, although not illustrated in the drawings, a second arm insertion hole through which the shaft member 21 is inserted and that is in communication with the second arm recessed portion 3121B is provided in the second arm portion 312B. Furthermore, although not illustrated in the drawings, a second arm fixing hole into which the fixing member 50 is inserted is provided in the second arm portion 312B.

The first body portion 313B couples the first arm portion 311B and the second arm portion 312B. In the present embodiment, the first arm portion 311B and the second arm portion 312B extend from the first body portion 313B toward a side opposite to the side on which the piece 2B is disposed.

The second outer piece component 320B includes a third arm portion 321B, a fourth arm portion 322B, and a second body portion 323B.

A third arm insertion hole 3211B through which the shaft member 21 of the spring bar 20 is inserted and a third arm fixing hole 3212B into which the fixing member 50 is inserted are provided in the third arm portion 321B.

A fourth arm insertion hole 3221B through which the shaft member 21 of the spring bar 20 is inserted is provided in the fourth arm portion 322B. Further, although not illustrated in the drawings, a fourth arm fixing hole into which the fixing member 50 is inserted is provided in the fourth arm portion 322B.

The second body portion 323B couples the third arm portion 321B and the fourth arm portion 322B. In the present embodiment, the third arm portion 321B and the fourth arm portion 322B extend from the second body portion 323B toward a side opposite to the side on which the piece 2B is disposed.

Middle Block

In the present embodiment, the middle piece 40B includes three components, namely, a first middle piece component 410B, a second middle piece component 420B, and a third middle piece component 430B. Further, in the present embodiment, the middle piece components 410B, 420B, and 430B are formed by subjecting a pure metal material to a process such as cutting or the like. Furthermore, in the present embodiment, the middle piece components 410B, 420B and 430B are disposed side by side along the axial direction O of the shaft member 21.

The first middle piece component 410B is a component that is disposed between the third arm portion 321B and the fourth arm portion 322B of the second outer piece part 320B. The first middle piece component 410B is provided with a first middle piece insertion hole 411B, a first middle piece fixing hole 412B, a first middle piece engagement recessed portion 413B, and a first middle piece coupling hole 414B. Note that the C-ring 52 is disposed in the first middle piece fixing hole 412B. In other words, the first middle piece fixing hole 412B configures the large diameter portion 431 of the first embodiment described above.

The second middle piece component 420B is a component that is disposed between the first arm portion 311B of the first outer piece component 310B and the fourth arm portion 322B of the second outer piece component 320B. The second middle piece component 420B is provided with a second middle piece insertion hole 421B through which the shaft member 21 is inserted, a second middle piece fixing hole 422B into which the fixing member 50 is inserted, and a second middle piece coupling hole 423B into which a coupling member (not illustrated) is inserted. Note that in the present embodiment, the first middle piece insertion hole 411B and the second middle piece insertion hole 421B configure the second insertion hole of the present disclosure.

The third middle piece component 430B is a component that is disposed between the first arm portion 311B and the second arm portion 312B of the first outer piece part 310B. In a similar manner to the third middle piece 430A of the second embodiment described above, the third middle piece component 430B is provided with a third middle piece recessed portion 431B, a third middle piece fixing hole 432B, a third middle piece engagement recessed portion 433B, and a third middle piece coupling hole 434B. Note that the second middle piece fixing hole 422B and the third middle piece fixing hole 432B configure the small diameter portion 432 of the first embodiment described above.

Effects of Third Embodiment

According to the third embodiment as described above, the following effects can be obtained.

In the present embodiment, the outer piece 30B includes the plurality of outer piece components 310B and 320B.

In this way, it is possible to increase variations in the design of the outer piece 30B configuring the band 1B. For this reason, the design of the band 1B can be further enhanced.

Fourth Embodiment

Next, a coupling tool 10C according to a fourth embodiment of the present disclosure will be described with reference to the drawings.

The coupling tool 10C of the fourth embodiment differs from the first to third embodiments described above in that a middle piece 40C includes five middle piece components 410C, 420C, 430C, 440C, and 450C. Note that components of the fourth embodiment that are identical or similar to the corresponding components of the first to third embodiments are denoted by identical reference signs and that descriptions of these components are omitted.

Coupling Tool

Figure 18:
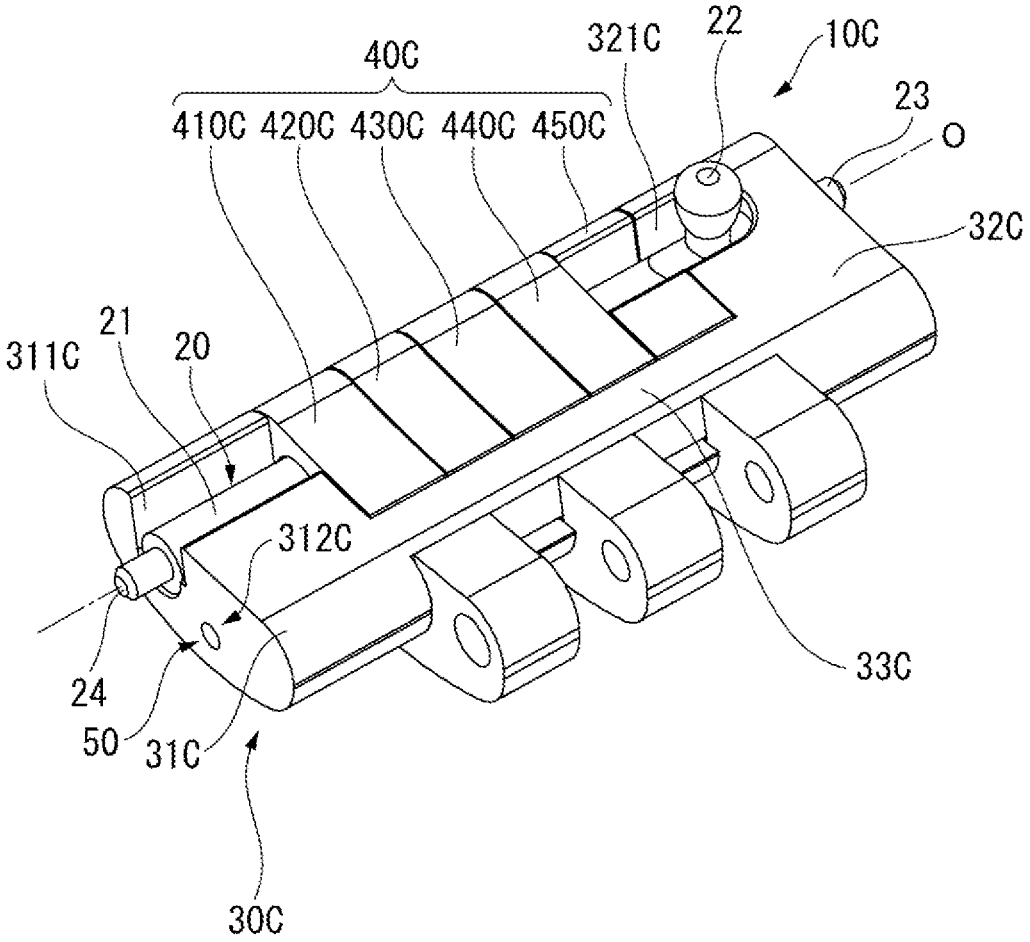
FIG. 18 is a perspective view illustrating a coupling tool according to a fourth embodiment.

FIG. 18 is a perspective view illustrating the coupling tool 10C according to the fourth embodiment.

As illustrated in FIG. 18, the coupling tool 10C of the present embodiment includes the spring bar 20, an outer piece 30C, the middle piece 40C, and the fixing member 50.

Outer Block

The outer piece 30C includes a first arm portion 31C, a second arm portion 32C, and a body portion 33C, and is configured in a similar manner to the second embodiment described above.

A first arm recessed portion 311C and a first arm fixing hole 312C are provided in the first arm portion 31C. A second arm recessed portion 321C, a second arm insertion hole (not illustrated), and a second arm fixing hole (not illustrated) are provided in the second arm portion 32C. The body portion 33C couples the first arm portion 31C and the second arm portion 32C.

Middle Block

In the present embodiment, the middle piece 40C includes the five components, namely, the first middle piece component 410C, the second middle piece component 420C, the third middle piece component 430C, the fourth middle piece component 440C, and the fifth middle piece component 450C. Further, in the present embodiment, the middle piece components 410C, 420C, 430C, 440C, and 450C are formed by subjecting a pure metal material to a process such as cutting or the like. Furthermore, in the present embodiment, the middle piece components 410C, 420C, 430C, 440C, and 450C are disposed side by side along the axial direction O of the shaft member 21, between the first arm portion 31C and the second arm portion 32C.

Effects of Fourth Embodiment

According to the fourth embodiment as described above, the following effects can be obtained.

In the present embodiment, the middle piece 40C includes the plurality of middle piece components 410C, 420C, 430C, 440C, and 450C.

For this reason, it is possible to increase variations in the design of the middle piece 40C.

Fifth Embodiment

Next, a band 1D according to a fifth embodiment of the present disclosure will be described below with reference to the drawings.

The band 1D of the fifth embodiment differs from the first to fourth embodiments described above in that an outer piece 30D is configured by a first outer piece component 310D and a second outer piece component 320D, and a first arm portion, a second arm portion, and a body portion are not provided on each of the outer piece components 310D and 320D. Note that components of the fifth embodiment that are identical or similar to the corresponding components of the first to fourth embodiments are denoted by identical reference signs and that descriptions of these components are omitted.

Figure 19:
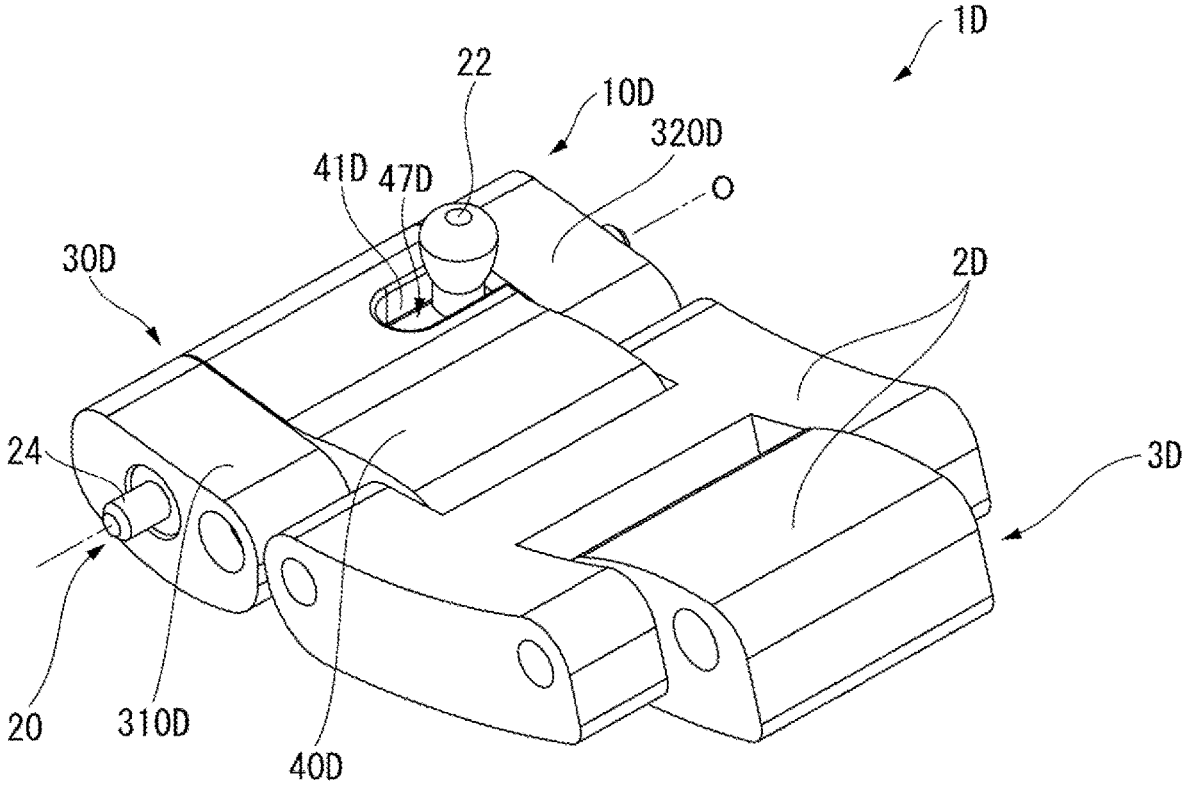
FIG. 19 is a perspective view illustrating a band according to a fifth embodiment.

FIG. 19 is a perspective view illustrating the band 1D according to the fifth embodiment.

As illustrated in FIG. 19, in a similar manner to the first to fourth embodiments described above, the band 1D includes a band main body 3D configured by combining a plurality of metal pieces 2D, and a coupling tool 10D that is coupled to both ends of the band main body 3D.

Coupling Tool

Figure 20:
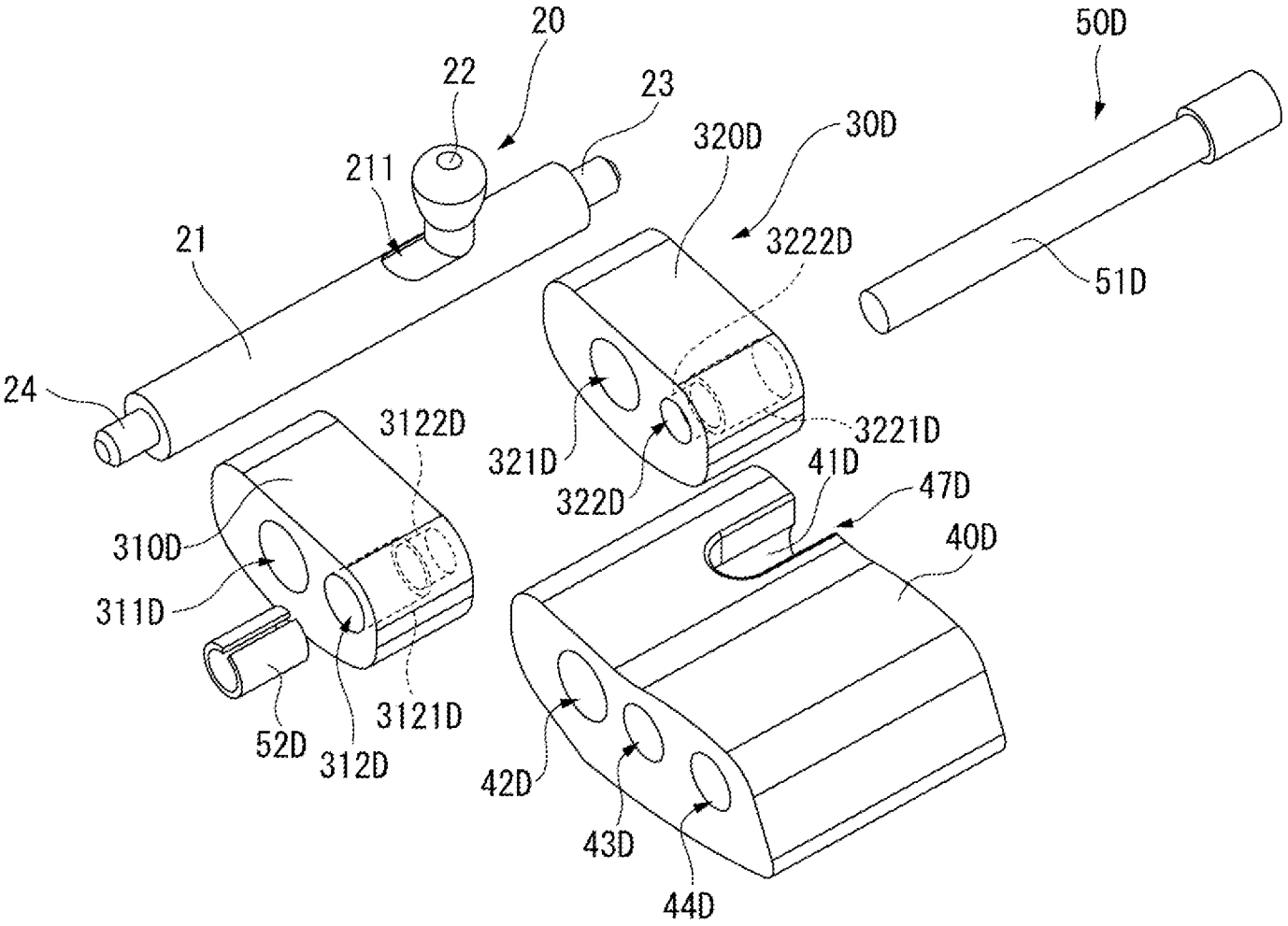
FIG. 20 is an exploded perspective view illustrating a coupling tool according to the fifth embodiment.
Figure 21:
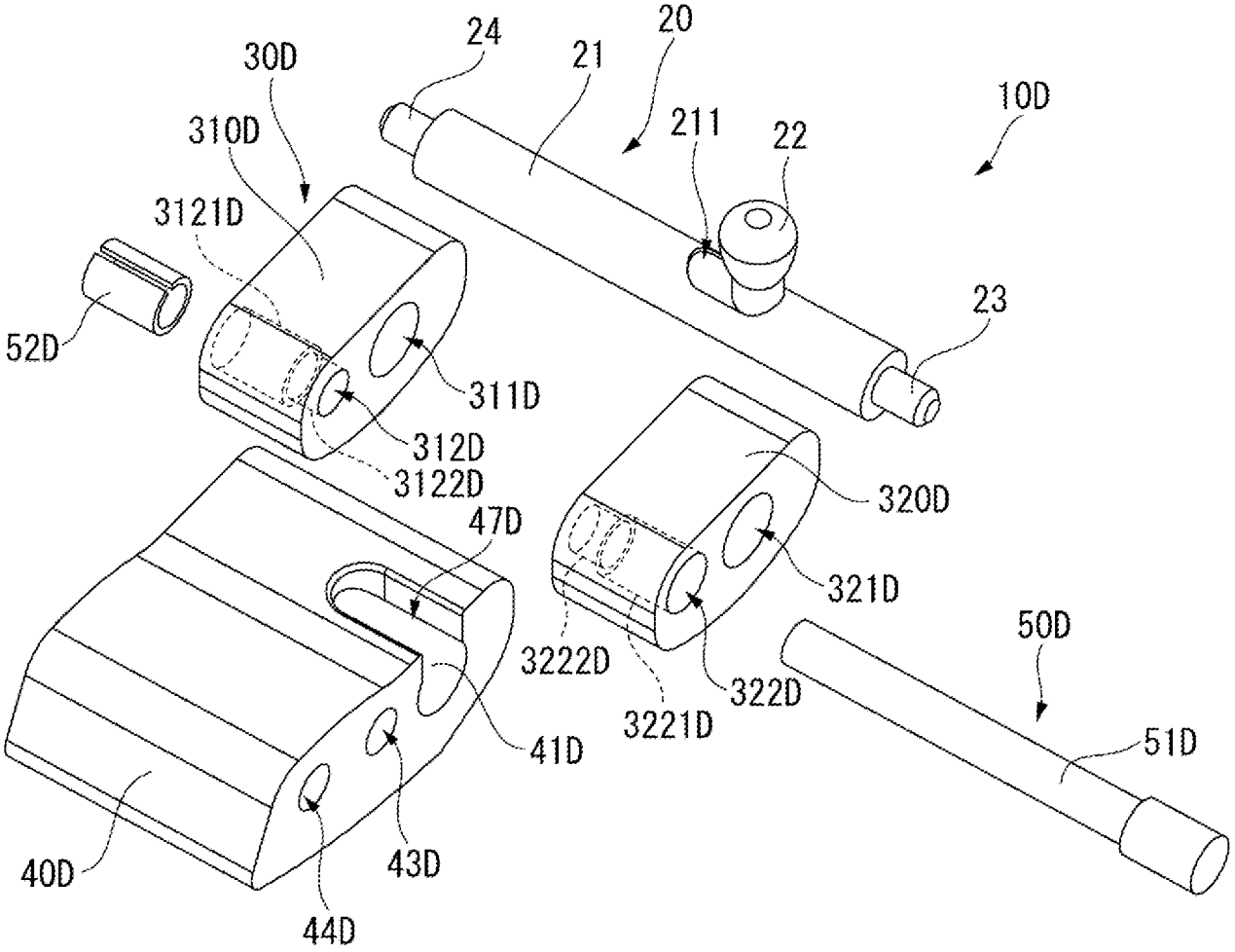
FIG. 21 is an exploded perspective view illustrating the coupling tool according to the fifth embodiment.

FIG. 20 and FIG. 21 are exploded perspective views illustrating the coupling tool 10D. Note that in FIG. 20 and FIG. 21, the coupling tool 10D is viewed from different directions. As illustrated in FIG. 20 and FIG. 21, the coupling tool 10D includes the spring bar 20, the outer piece 30D, a middle piece 40D, and a fixing member 50D. Note that in the present embodiment, one end of a pin 51D of the fixing member 50D is a stepped portion having a large diameter.

Outer Block

In the present embodiment, the outer piece 30D includes two pieces, namely, the first outer piece component 310D and the second outer piece component 320D.

Further, in the present embodiment, the outer piece components 310D and 320D are formed by subjecting a pure metal material to a process such as cutting or the like.

The first outer piece component 310D is provided with a first outer piece insertion hole 311D through which the shaft member 21 of the spring bar 20 is inserted, and a first outer piece fixing hole 312D into which the fixing member 50D is inserted. Then, the first outer piece fixing hole 312D includes a large diameter portion 3121D in which a C-ring 52D is disposed, and a small diameter portion 3122D having a diameter smaller than that of the large diameter portion 3121D.

The second outer piece component 320D is provided with a second outer piece insertion hole 321D through which the shaft member 21 of the spring bar 20 is inserted, and a second outer piece fixing hole 322D into which the fixing member 50D is inserted. Then, the second outer piece fixing hole 322D includes a large diameter portion 3221D in which the step portion of the pin 51D is disposed, and a small diameter portion 3222D having a diameter smaller than that of the large diameter portion 3221D.

Middle Block

In the present embodiment, the middle piece 40D is configured by one piece, in a similar manner to the first embodiment described above. Then, the middle piece 40D is disposed between the first outer piece component 310D and the second outer piece component 320D.

Further, the middle piece 40D is provided with a middle piece recessed portion 41D, a middle piece insertion hole 42D, a middle piece fixing hole 43D, and a middle piece coupling hole 44D.

The middle piece recessed portion 41D is a recessed portion in which the shaft member 21 of the spring bar 20 is disposed, and is provided along the axial direction O of the shaft member 21. In the present embodiment, the middle piece recessed portion 41D is provided at a position corresponding to the second outer piece insertion hole 321D of the second outer piece component 320D, that is, adjacent to the second outer piece insertion hole 321D, and is in communication with the middle piece insertion hole 42D. Further, the operation portion 22 of the spring bar 20 is arranged so as to protrude from an opening 47D of the middle piece recessed portion 41D.

The middle piece insertion hole 42D is a hole through which the shaft member 21 of the spring bar 20 is inserted, and is provided along the axial direction O of the shaft member 21. In the present embodiment, the middle piece insertion hole 42D is provided at a position corresponding to the first outer piece insertion hole 311D of the first outer piece component 310D, that is, adjacent to the first outer piece insertion hole 311D.

In this way, in the present embodiment, the first outer piece insertion hole 311D, the middle piece insertion hole 42D, the middle piece recessed portion 41D, and the second outer piece insertion hole 321D are arranged in this order along the axial direction O.

The middle piece fixing hole 43D is a hole into which the fixing member 50 is inserted, and is provided along the axial direction O.

The middle piece coupling hole 44D is a hole through which a coupling member (not illustrated) for coupling the middle piece 40D and the piece 2D is inserted.

Effects of Fifth Embodiment

According to the fifth embodiment as described above, the following effects can be obtained.

In the present embodiment, the outer piece 30D includes the first outer piece component 310D and the second outer piece component 320D. Then, the first outer piece component 310D and the second outer piece component 320D are not provided with a first arm portion, a second arm portion, and a body portion, as are provided in the first to fourth embodiments described above.

In this way, a degree of freedom of design of the outer piece 30D configuring the band 1D can be increased, and it is thus possible to increase variations in the design. For this reason, the design of the band 1D can be further enhanced.

Modified Examples

Note that the present disclosure is not limited to each of the embodiments described above, and modifications, improvements, and the like within a scope in which the object of the present disclosure can be achieved are included in the present disclosure.

In each of the embodiments described above, the middle pieces 40, 40A, 40B, 40C, and 40D are fixed to the outer pieces 30, 30A, 30B, 30C, and 30D by the fixing members 50 and 50D, but the configuration is not limited thereto. For example, the middle piece may be fixed to the outer piece by gluing, welding, screws, or the like.

In each of the embodiments described above, the pieces 2, 2A, 2B, and 2D configuring the bands 1, 1A, 1B, and 1D, the outer pieces 30, 30A, 30B, 30C, and 30D and the middle pieces 40, 40A, 40B, 40C, and 40D are formed from a pure metal material, but the material is not limited thereto. For example, these components may be formed from ceramic or resin.

In the first, second, and fourth embodiments, the second arm recessed portions 321, 321A, and 321C are provided in the second arm portions 32, 32A, and 32C, but the configuration is not limited thereto. For example, a case in which the second arm recessed portion is not provided in the second arm portion is also included in the present disclosure. In this case, a range of motion of the operation portion of the spring bar may be regulated by the middle piece recessed portion and the second arm portion.

In the first to fourth embodiments, the middle piece recessed portions (the second recessed portions) 41, 41A, and 431B are provided in the middle pieces 40, 40A, 40B, and 40C, but the configuration is not limited thereto. For example, in the axial direction of the shaft member, when the width of the second arm portion is greater than the width of the middle piece, the middle piece recessed portion, that is, the recessed portion from which the operation portion of the spring bar protrudes, need not necessarily be provided in the middle piece. In this case, the shaft member of the spring bar may be held by the middle piece insertion hole of the middle piece, and the operation portion of the spring bar may be regulated by the second arm recessed portion provided in the second arm portion, and by the side surface of the middle piece.

Further, in the fifth embodiment, the middle piece recessed portion 41D is provided in the middle piece 40D, but the configuration is not limited thereto. For example, the recessed portion from which the operation portion of the spring bar protrudes may be provided in the second outer piece component. In this case, the shaft member of the spring bar may be held by the middle piece insertion hole of the middle piece, and the operation portion of the spring bar may be regulated by the second outer piece recessed portion provided in the second outer piece component, and by the side surface of the middle piece.

Effects similar to those of the embodiments described above can also be obtained with this type of configuration.

In each of the embodiments described above, the bands 1, 1A, 1B, and 1D of the watch 100 are exemplified, but the configuration is not limited thereto. For example, the present disclosure can be applied to a wrist-worn device, such as a pulse meter, and to a band attached to the wrist-worn device.

Summary of Present Disclosure

A band according to an aspect of the present disclosure includes a spring bar including a shaft member, an operation portion, and a protruding member, an outer piece including a first arm portion, a second arm portion, and a body portion coupling the first arm portion and the second arm portion, and a middle piece disposed between the first arm portion and the second arm portion. The first arm portion includes a first recessed portion provided along an axial direction of the shaft member, the second arm portion includes a first insertion hole provided along the axial direction, and the middle piece includes a second insertion hole provided along the axial direction and a second recessed portion provided along the axial direction and in communication with the second insertion hole. The first recessed portion, the second insertion hole, the second recessed portion, and the first insertion hole are disposed in this order along the axial direction, and the spring bar is inserted through the first recessed portion, the second insertion hole, the second recessed portion, and the first insertion hole. The operation portion is disposed protruding from an opening of the second recessed portion, and the operation portion is configured to move in the axial direction in this state.

In this way, when the operation portion is moved along the axial direction, it is possible to suppress the spring bar from becoming disengaged from the outer piece and the middle piece. Further, since a disengagement prevention structure of the spring bar can be achieved without bending a portion of a metal component, the outer piece and the middle piece configuring the disengagement prevention structure can be manufactured from a pure metal material.

As a result, a band having excellent design properties and a high quality feel can be obtained.

In the band according to the aspect of the present disclosure, the second arm portion may include a third recessed portion provided contiguously to the second recessed portion along the axial direction.

In this way, the middle piece can be easily disposed between the first arm portion and the second arm portion, and the assembly of the band can be made easy.

In the band according to the aspect of the present disclosure, the middle piece may be fixed between the first arm portion and the second arm portion by a C-ring and a pin.

In this way, the middle piece can be fixed to the outer piece with a simple structure. Further, since the middle piece can be removed from the outer piece if the pin is removed, it is possible to replace the middle piece, such as when the middle piece is damaged, for example.

In the band according to the aspect of the present disclosure, the middle piece may be configured to include a plurality of middle piece components.

In this way, it is possible to increase variations in the design of the middle piece configuring the band. For this reason, the design of the band can be further enhanced.

In the band according to the aspect of the present disclosure, the middle piece may include an engagement recessed portion that engages with the body portion.

In this way, the middle piece is fixed to the outer piece after the engagement recessed portion and the body portion are engaged with each other, and it is thus possible to more reliably fix the middle piece with respect to the outer piece.

A band according to another aspect of the present disclosure includes a spring bar including a shaft member, an operation portion, and a protruding member, an outer piece including a first outer piece component and a second outer piece component, and a middle piece that is disposed between the first outer piece component and the second outer piece component. The first outer piece component includes a first outer piece insertion hole provided along an axial direction of the shaft member, the second outer piece component includes a second outer piece insertion hole provided along the axial direction, and the middle piece includes a middle piece insertion hole provided along the axial direction and a middle piece recessed portion provided along the axial direction and in communication with the middle piece insertion hole. The first outer piece insertion hole, the middle piece insertion hole, the middle piece recessed portion, and the second outer piece insertion hole are disposed in this order along the axial direction, and the spring bar is inserted through the first outer piece insertion hole, the middle piece insertion hole, the middle piece recessed portion, and the second outer piece insertion hole. The operation portion is disposed protruding from an opening of the middle piece recessed portion, and the operation portion is configured to move in the axial direction in this state.

A watch according to another aspect of the present disclosure includes the band.

What is claimed is:

1. A band comprising:

a spring bar including a shaft member, an operation portion, and a protruding member;

an outer piece including a first arm portion, a second arm portion, and a body portion coupling the first arm portion and the second arm portion; and a middle piece disposed between the first arm portion and the second arm portion, wherein the first arm portion includes a first recessed portion provided along an axial direction of the shaft member, the second arm portion includes a first insertion hole provided along the axial direction, the middle piece includes a second insertion hole provided along the axial direction, and a second recessed portion provided along the axial direction and in communication with the second insertion hole, the first recessed portion, the second insertion hole, the second recessed portion, and the first insertion hole are disposed in this order along the axial direction, and the spring bar is inserted through the first recessed portion, the second insertion hole, the second recessed portion, and the first insertion hole, the operation portion is disposed protruding from an opening of the second recessed portion, and the operation portion is configured to move in the axial direction in this state.

2. The band according to claim 1, wherein the second arm portion includes a third recessed portion provided contiguously to the second recessed portion along the axial direction.

3. The band according to claim 1, wherein the middle piece is fixed between the first arm portion and the second arm portion by a C-ring and a pin.

4. The band according to claim 2, wherein the middle piece is fixed between the first arm portion and the second arm portion by a C-ring and a pin.

5. The band according to claim 1, wherein the middle piece includes a plurality of middle piece components.

6. The band according to claim 2, wherein the middle piece includes a plurality of middle piece components.

7. The band according to claim 3, wherein the middle piece includes a plurality of middle piece components.

8. The band according to claim 4, wherein the middle piece includes a plurality of middle piece components.

9. The band according to claim 1, wherein the middle piece includes an engagement recessed portion that engages with the body portion.

10. The band according to claim 2, wherein the middle piece includes an engagement recessed portion that engages with the body portion.

11. The band according to claim 3, wherein the middle piece includes an engagement recessed portion that engages with the body portion.

12. The band according to claim 5, wherein the middle piece includes an engagement recessed portion that engages with the body portion.

13. A band comprising:

a spring bar including a shaft member, an operation portion, and a protruding member;

an outer piece including a first outer piece component and a second outer piece component; and a middle piece disposed between the first outer piece component and the second outer piece component, wherein the first outer piece component includes a first outer piece insertion hole provided along an axial direction of the shaft member, the second outer piece component includes a second outer piece insertion hole provided along the axial direction, the middle piece includes a middle piece insertion hole provided along the axial direction, and a middle piece recessed portion provided along the axial direction and in communication with the middle piece insertion hole, the first outer piece insertion hole, the middle piece insertion hole, the middle piece recessed portion, and the second outer piece insertion hole are disposed in this order along the axial direction, and the spring bar is inserted through the first outer piece insertion hole, the middle piece insertion hole, the middle piece recessed portion, and the second outer piece insertion hole, the operation portion is disposed protruding from an opening of the middle piece recessed portion, and the operation portion is configured to move in the axial direction in this state.

14. A watch comprising:

the band according to claim 1.

15. A watch comprising:

the band according to claim 2.

16. A watch comprising:

the band according to claim 3.

17. A watch comprising:

the band according to claim 5.

18. A watch comprising:

the band according to claim 9.

19. A watch comprising:

the band according to claim 13.

* * * * *